US011209240B2

(12) United States Patent
Treto et al.

(10) Patent No.: US 11,209,240 B2
(45) Date of Patent: Dec. 28, 2021

(54) DUTY HOLSTER

(71) Applicant: Tedder Industries, LLC, Post Falls, ID (US)

(72) Inventors: Timothy Treto, Mead, WA (US); Drew Stephens, Coeur d'Alene, ID (US); Igor Shirobokov, Spokane, WA (US); Silas Van Natter, Post Falls, ID (US); Taylor Vold, Valleyford, WA (US)

( * ) Notice: Subject to any disclaimer, the term of this patent is extended or adjusted under 35 U.S.C. 154(b) by 97 days.

(21) Appl. No.: 16/587,427

(22) Filed: Sep. 30, 2019

(65) Prior Publication Data

US 2020/0292272 A1 Sep. 17, 2020

Related U.S. Application Data

(60) Provisional application No. 62/818,491, filed on Mar. 14, 2019.

(51) Int. Cl.
*F41C 33/04* (2006.01)
*F41C 33/02* (2006.01)

(52) U.S. Cl.
CPC ..... *F41C 33/0263* (2013.01); *F41C 33/0209* (2013.01); *F41C 33/041* (2013.01)

(58) Field of Classification Search
CPC . F41C 33/0263; F41C 33/0209; F41C 33/041
See application file for complete search history.

(56) References Cited

U.S. PATENT DOCUMENTS

| | | | | |
|---|---|---|---|---|
| 6,371,341 | B1 * | 4/2002 | Clifton, Jr. | F41C 33/0227 224/242 |
| 7,461,765 | B2 * | 12/2008 | French | F41C 33/0227 224/243 |
| 8,235,263 | B1 * | 8/2012 | Yeates | F41C 33/0263 224/243 |
| 9,134,093 | B2 * | 9/2015 | Yeates | F41C 33/0272 |
| 9,175,925 | B2 * | 11/2015 | Pellegrini | F41C 33/0227 |
| 10,619,974 | B2 * | 4/2020 | Smith | A45F 5/021 |
| 2004/0050887 | A1 * | 3/2004 | Spielberger | F41C 33/041 224/244 |
| 2009/0294496 | A1 * | 12/2009 | Gallagher | F41C 33/0263 224/243 |
| 2009/0321480 | A1 * | 12/2009 | Kincaid | F41C 33/0227 224/243 |
| 2010/0176165 | A1 * | 7/2010 | Lowe | F41C 33/0263 224/191 |

(Continued)

*Primary Examiner* — Derek J Battisti

(57) ABSTRACT

Representative implementations of devices and techniques provide locking systems and/or retention mechanisms for an implement holster (such as a handgun holster, for example). Additionally, an implement holster having one or more locking systems and/or retention mechanisms is also described. Locking systems and retention mechanisms may be used individually with a holster or combined for multi-level security of the implement. The one or more locking systems can provide obstruction to the removal of the implement from the holster until intentionally unlocked by the user. Locking systems include hood locks, ejection port locks, and sight covers. Adjustable retention mechanisms can provide a desired retention of the implement while holstered, retaining the implement until a sufficient force is applied to remove the implement.

24 Claims, 19 Drawing Sheets

(56) References Cited

U.S. PATENT DOCUMENTS

| | | | | |
|---|---|---|---|---|
| 2011/0101063 | A1* | 5/2011 | Zusman | F41C 33/0254<br>224/682 |
| 2013/0075435 | A1* | 3/2013 | Hellweg | F41C 33/0227<br>224/243 |

* cited by examiner

DUTY HOLSTER

PRIORITY CLAIM AND CROSS-REFERENCE TO RELATED APPLICATION

This application claims the benefit under 35 U.S.C. § 119(e)(1) of U.S. Provisional Application No. 62/818,491, filed Mar. 14, 2019, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and re-holstered, usually with the same hand. However, the holster should also be versatile enough to be comfortably carried by the user, such as when it is worn on the person of the user for an extended length of time.

In many circumstances it can be desirable to have one or more safety or locking mechanisms incorporated into a holster, to provide security against the handgun being released from the holster unintentionally or by an unauthorized individual. For example, in the case of a police officer's holster, it can be desirable for the holster to have mechanisms to retain the handgun against accidental removal as well as all unauthorized attempts to remove the handgun, until the police officer intentionally releases the handgun from the holster. Then, it should be relatively quick and easy for the police officer to disable the locking mechanisms and remove the handgun from the holster.

Balancing ease of intentional access with security against unauthorized access can be problematic. Often, attaining one of these desired characteristics can come at the cost of the other.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

FIG. 5A shows the mechanism in a locked configuration and FIG. 5B shows the mechanism in an unlocked configuration.

FIG. 6A shows the hood in a closed configuration and FIG. 6B shows the hood in an open configuration.

FIG. 7A shows the hood in a locked configuration, FIG. 7B shows the hood in an unlocked configuration, and FIG. 7C shows the hood in an open configuration.

FIG. 9A shows the ejection port lock mechanism in a locked configuration and FIG. 9B shows the ejection port lock mechanism in an unlocked configuration.

FIG. 10A shows the ejection port lock mechanism in a locked configuration and FIG. 10B shows the ejection port lock mechanism in an unlocked configuration.

FIG. 11A shows the ejection port lock mechanism in a locked configuration and FIG. 11B shows the ejection port lock mechanism in an unlocked configuration.

FIG. 12A shows the ejection port lock mechanism in a locked configuration and FIG. 12B shows the ejection port lock mechanism in an unlocked configuration.

FIG. 13A shows a front view, FIG. 13B shows a cross-sectional side view, and FIG. 13C shows a bottom view of the example latch member.

FIG. 14A shows the latch member in a locked configuration and FIG. 14B shows the latch member in an unlocked configuration.

DETAILED DESCRIPTION

Overview

Figure 1:
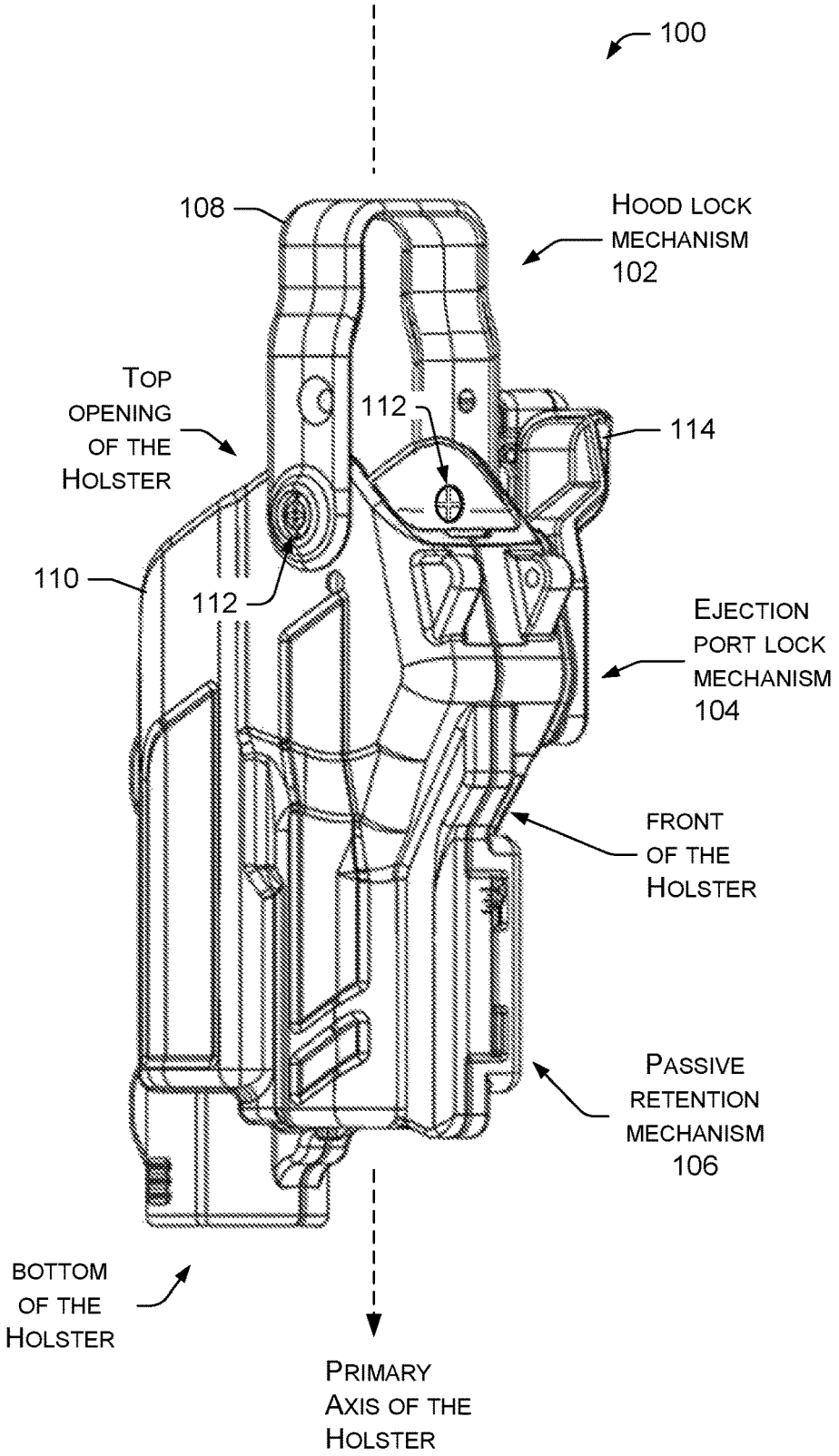
FIG. 1 shows a front perspective view of an example duty holster, according to an implementation.
Figure 2:
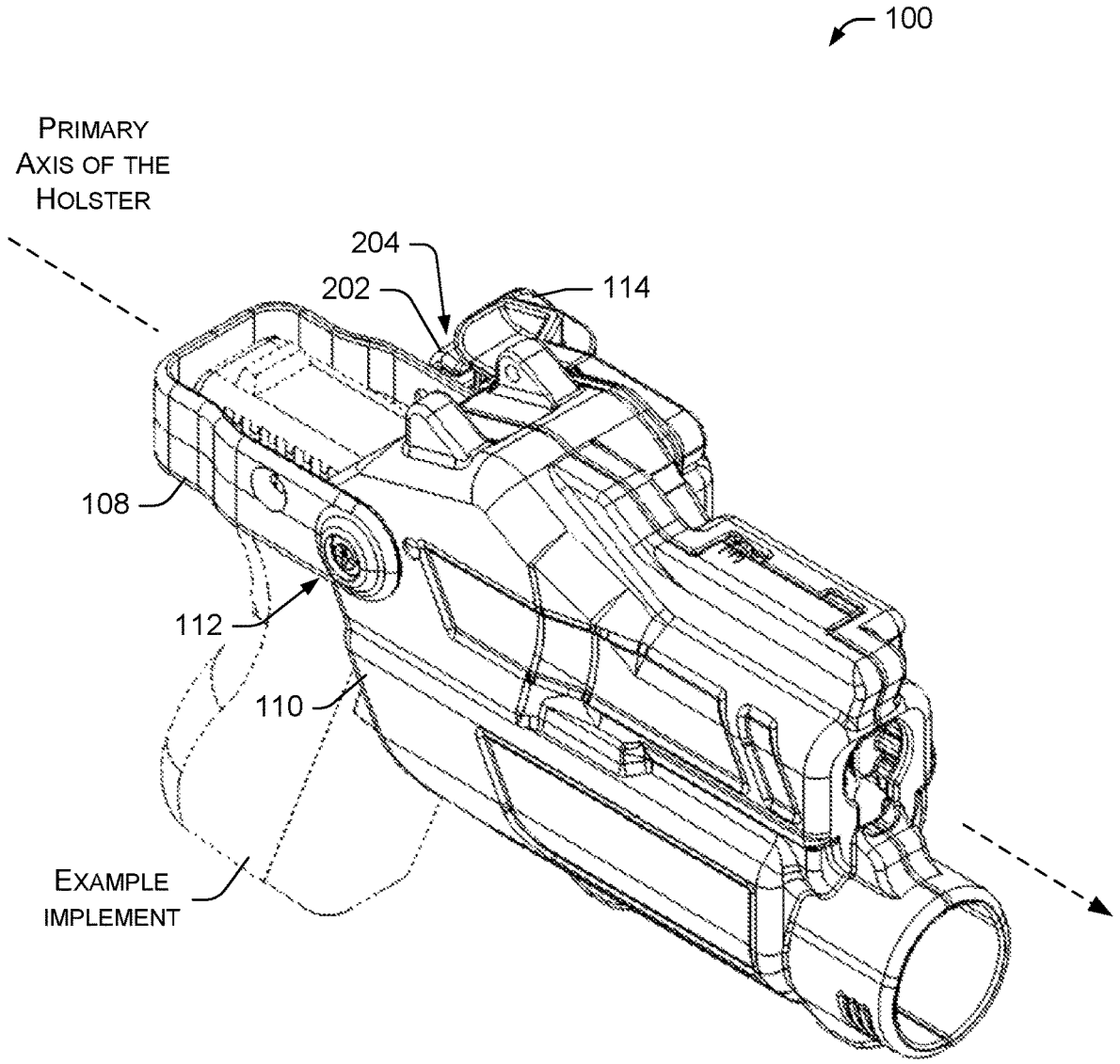
FIG. 2 shows another perspective view from a right side of an example duty holster, according to an implementation.
Figure 3:
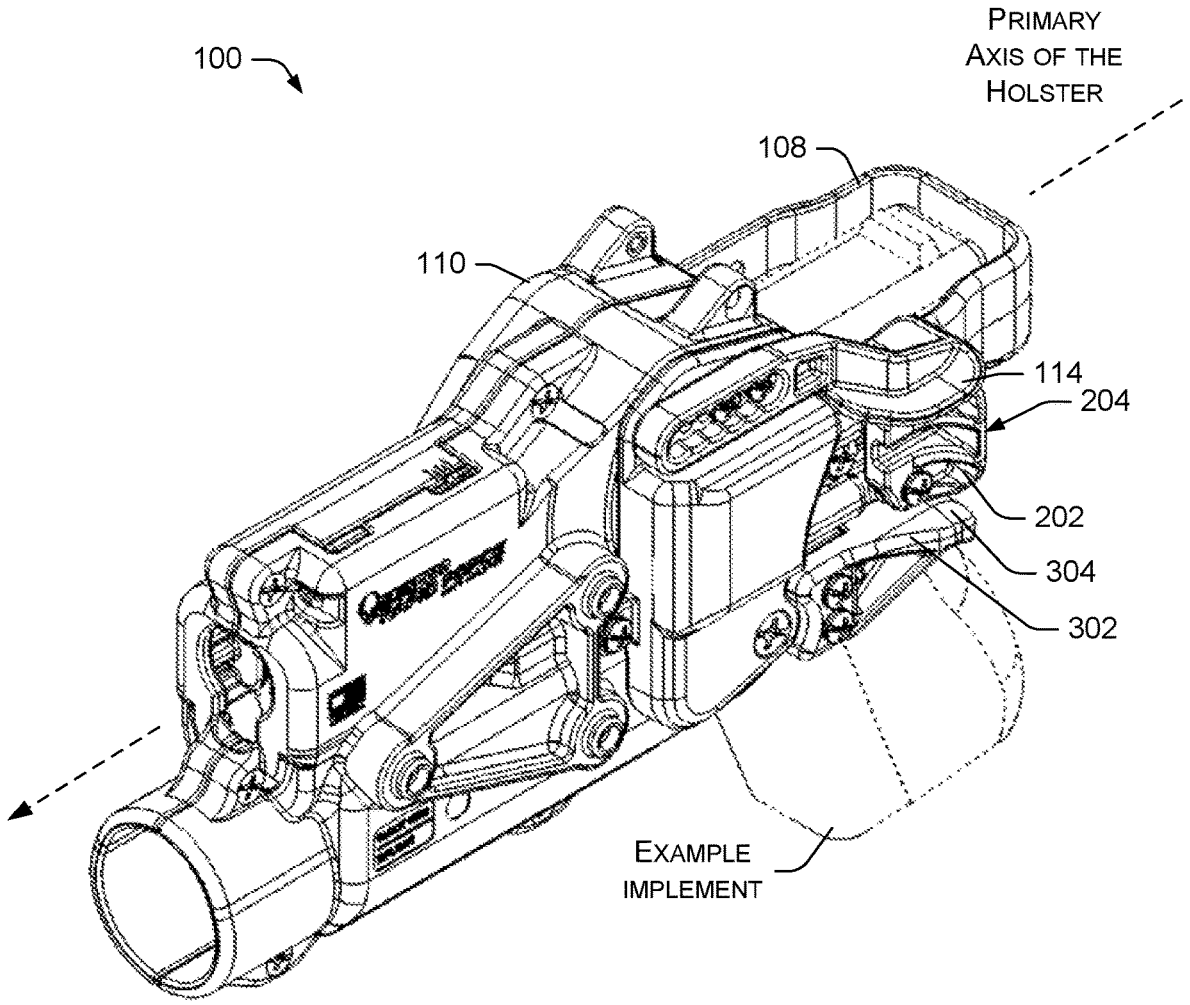
FIG. 3 shows a further perspective view from a left side of an example duty holster, according to an implementation.
Figure 4:
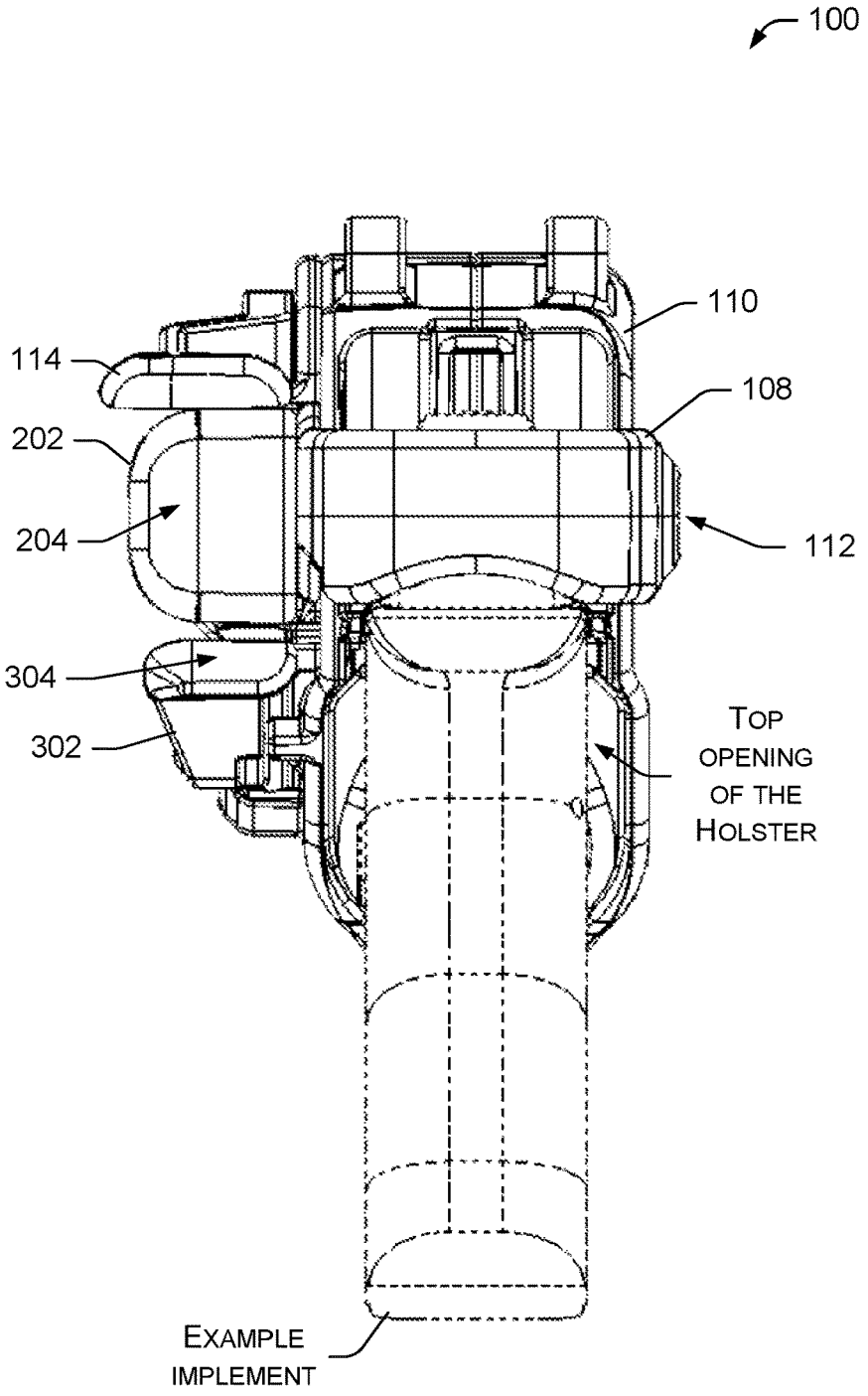
FIG. 4 shows a top view of an example duty holster, according to an implementation.

Representative implementations of devices and techniques provide a duty holster 100 (such as a handgun holster, for example) having one or more locking systems, mechanisms, or components for safely locking the implement within the holster 100 until intentionally released by the user. For instance, the one or more locking systems can be operative to prevent the implement (e.g., handgun, etc.) from accidentally falling out of the holster 100, or from being removed from the holster 100 unexpectedly (for instance by another person during a physical altercation), and so forth. The one or more locking systems can provide an obstruction to the removal of the implement from the holster 100 until intentionally unlocked by the user.

In various embodiments, the one or more locking systems can be configured and arranged to be unlocked while the user grips the implement, so that the implement can be quickly and easily withdrawn from the holster 100. For instance, actuators to unlock the locking systems can be arranged for easy access and operation by the user, within reach of the user's thumb or finger(s) on the hand that grips the implement. In some embodiments, actuators may be operated in sequence or simultaneously (in embodiments having multiple locking systems or components) using one hand in a fluid action by the user while withdrawing the implement from the holster.

The duty holster 100 may be coupled to various attachment means (belt slide, paddle, backer, modular coupler, strap, belt, etc.) for wearing or carrying the holster 100 in many configurations. For instance, the holster 100 may be worn at the user's waist, under the user's shoulder or arm, at the user's hip, or at another location as desired.

The descriptions herein refer to a primary axis of the holster 100 (see FIGS. 1, 2, 3, 8, and 9A), defined as an axis running from the top opening of the holster 100 (where the implement is inserted) to the bottom of the holster 100 (which encloses the end of the barrel of a handgun, for example). This primary axis is convenient for consistency in discussing the orientation of various components and their movement relative to portions of the holster 100. For example, an implement would typically be holstered by moving a first end of the implement (e.g., the barrel end of a handgun) into the opening of the holster 100 at the top of the holster 100, and then moving the implement within the holster 100 along the primary axis of the holster 100, until the implement is settled within the holster 100, with the first end of the implement at the bottom of the holster 100. The use of the terms "top" and "bottom" and so forth, are for convenience in describing the holster 100 and the locking systems and components, and do not limit the possible orientations of the holster 100, or the manner in which the holster 100 may be worn or carried on a person. While the implement is holstered, the primary axis of the holster runs through the implement (through the length of the barrel of a handgun, for example).

Techniques and devices are discussed herein with reference to example firearm holsters illustrated in the figures. However, this is not intended to be limiting, and is for ease of discussion and illustrative convenience. The techniques and devices discussed may be applied to any of various cases, case designs, combinations, and the like, (e.g., enclosures, sheaths, covers, cases, carriers, etc.) for encasing tools, weapons, or other implements and accessories, and remain within the scope of the disclosure. For the purposes of this disclosure, the use of the terms "carrier" or "holster" are interchangeable, and both terms apply equally to various holsters, carriers, covers, cases, enclosures, sheaths, etc. Further, the shape of the holsters and various components illustrated in the figures may vary to accommodate the various implements to be carried, as well as to accommodate various applications.

Implementations are explained in more detail below using a plurality of examples. Although various implementations and examples are discussed here and below, further implementations and examples may be possible by combining the features and elements of individual implementations and examples.

Example Implementations

In various implementations, an example duty holster 100 comprises a shell component (e.g., holster body 110) configured to enclose an implement (such as a handgun, for example) or at least part of the implement, for safely carrying the implement on a person, on a person's accessories, in a vehicle, on an item of furniture, or otherwise convenient to the user. The shell 110 may be formed to the contours of the implement, so that the implement fits snugly within the holster 100. Alternately, the shell 110 may be formed with additional contours to accommodate accessories that may be coupled to the implement.

In various embodiments, the duty holster 100 may include one or more locking systems, mechanisms, or components coupled to an outside and/or inside surface of the holster body 110, including a hood lock mechanism 102, an ejection port lock mechanism 104, and a passive retention mechanism 106. In alternate implementations, a duty holster 100 may also include other locking systems, mechanisms, or components as well. In the various implementations, the one or more locking systems, mechanisms, or components may be operated simultaneously by the user, or in a sequence, to release the implement from the holster 100. In some cases, two or more of the locking systems, mechanisms, or components may be operated simultaneously, with others following or preceding in a sequence of user actions.

In many cases, the one or more locking systems, mechanisms, or components may be set in a locked configuration automatically by inserting the implement into the holster 100. For instance, inserting the implement into the holster 100 may cause the implement to move against a locking system component, moving the component and putting the component and its associated mechanism or system into a locked state.

Once in the locked state, the one or more locking systems, mechanisms, or components may remain locked until acted on intentionally by the user. For instance, the user can intentionally move an actuator, or the like, to unlock one or more of the locking systems or mechanisms. Once all associated locking systems and mechanisms have been unlocked, the implement may be removed from the holster 100. In general, the one or more locking systems, mechanisms, or components may remain in the unlocked state until the implement is returned to the holster 100.

Example Hood Lock Mechanism

FIGS. 1-8 and 17A-18B illustrate embodiments of duty holsters 100 that include a hood lock mechanism 102. The duty holsters 100 may or may not also include other locking systems or components as well. The hood 108 of the hood lock system 102 comprises a partial or full cover over the back end of the implement (such as the rear portion of the slide of a handgun, for example). The hood 108 provides an obstruction to the removal of the implement from the holster 100, since the hood 108 is disposed over the top opening of the holster 100, trapping the implement within the holster 100.

The example hood 108 illustrated in FIGS. 1-8 is a curved rigid loop or U-shaped component, however, other hood 108 shapes are also possible. For instance, in some embodiments, the hood 108 may include a full or partial enclosure (as shown at FIGS. 17A-18B, for example). The hood 108 comprises a rigid cover over the top opening of the holster 100, and may partially or fully conceal the rear portion of the implement (see FIG. 1). With the hood 108 in the closed position (as shown in FIGS. 1-4) the implement is blocked from being removed from the holster 100.

Figure 7A:
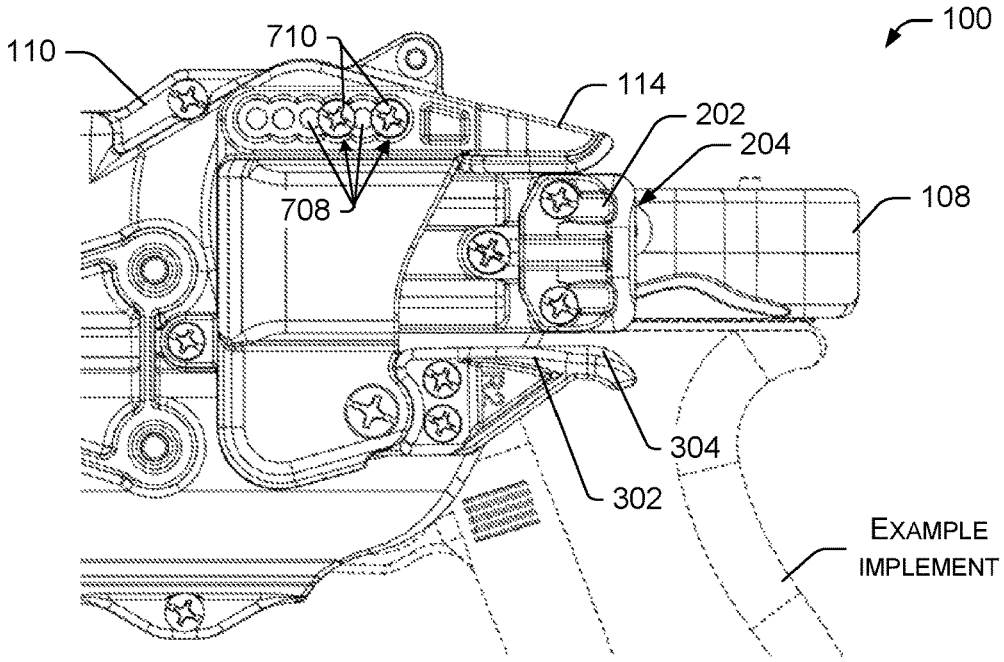
FIGS. 7A-7C show three views of hood lock actuation, according to an embodiment.
Figure 7B:
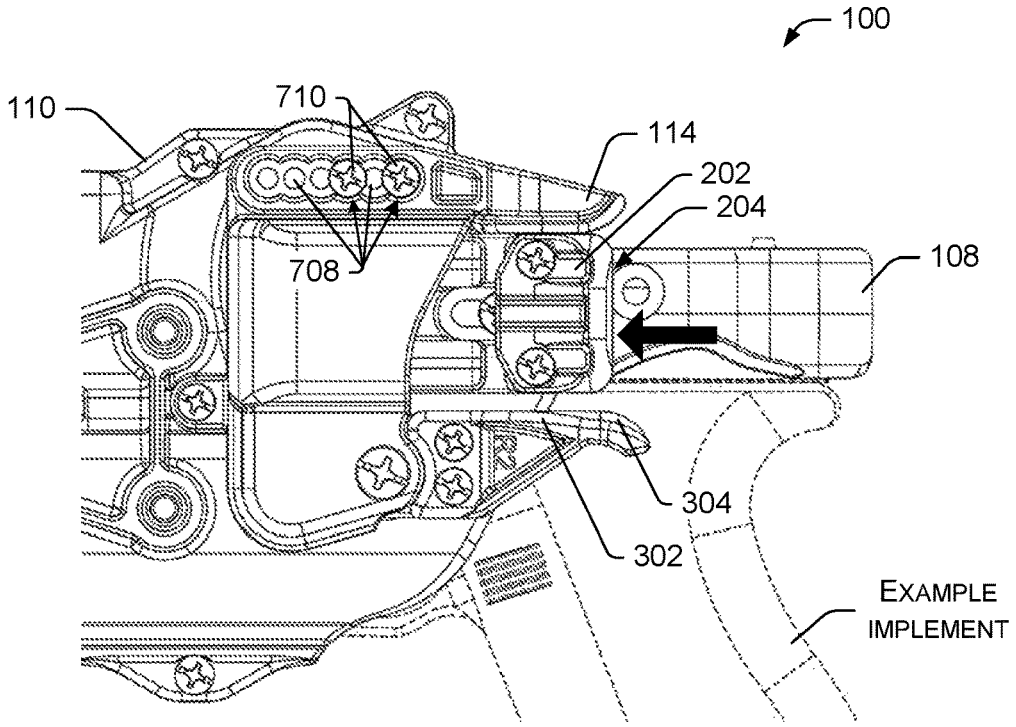
Figure 7C:
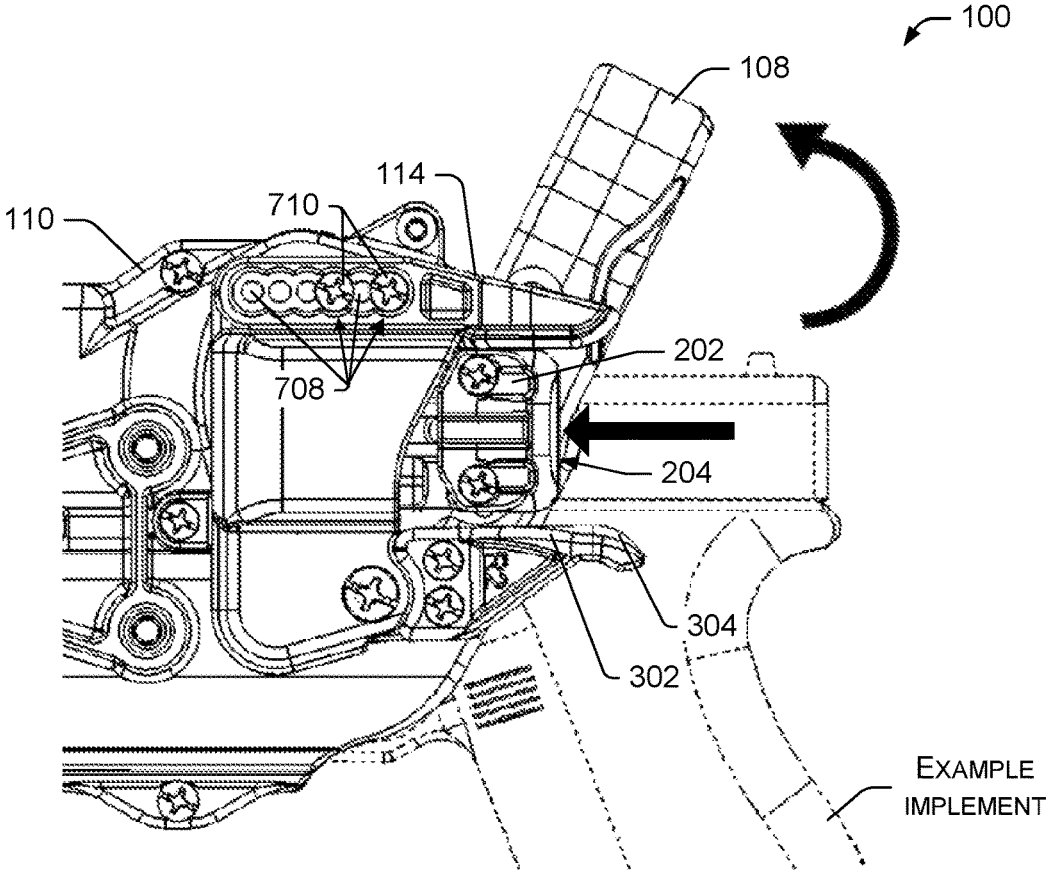
Figure 8:
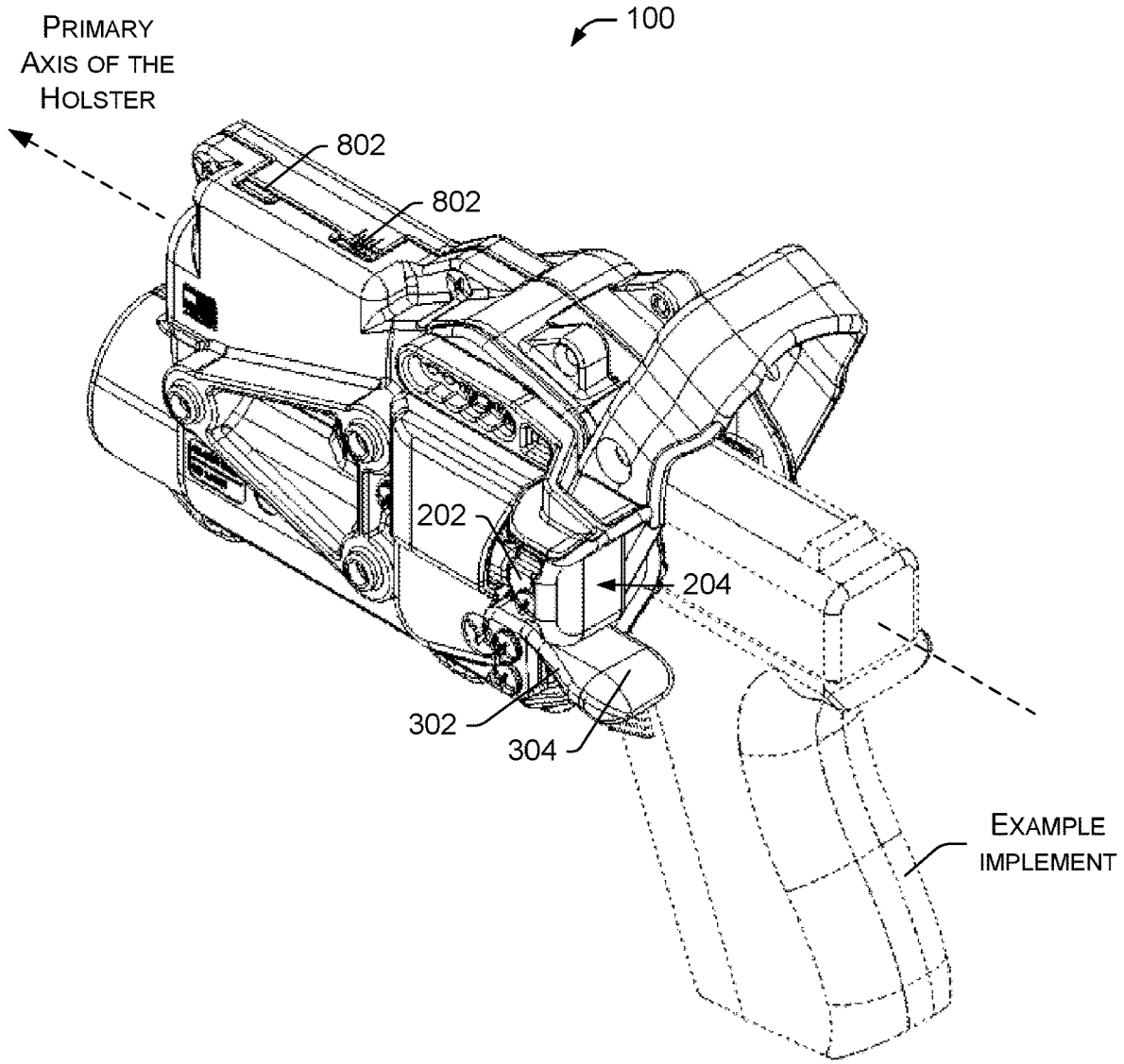
FIG. 8 shows a perspective view of an example duty holster with an unlocked hood lock, according to an implementation.

In an implementation, the hood 108 is pivotally coupled to the holster body 110, and is configured to pivot toward the front of the holster 100 when actuated (e.g., unlocked and opened). For instance, the hood 108 pivots on an axis normal to the primary axis of the holster 100, in a "pitch" motion over the top of the rear portion of the implement, clearing the top opening of the holster 100 when unlocked and opened. When the hood 108 is actuated and pivots into the open configuration (as shown in FIGS. 7C and 8), this clears the way for the implement to be removed through the top opening of the holster 100.

The pivot point 112 for the hood 108 is purposefully located relative to the hood 108 and the holster body 110 so that the force of pulling the implement from the holster 100 against the hood 108 results in a shearing force. With the shearing force arrangement, a higher force may be withstood by the hood 108 and its components, insuring against a failure of the hood lock system 102.

In various implementations, as shown in FIGS. 2-5B, the hood locking system 102 includes a hood release 202, which is used to put the hood 108 into the open configuration. The hood release 202 may comprise a single rigid member or multiple rigid sections coupled together. The hood release 202 is moveably coupled to the body 110 of the holster 100 to unlock the hood 108. In an embodiment, the hood release 202 is slideably coupled to the body 110, so that the hood release 202 moves forward and back parallel to the primary axis of the holster 100. The hood release 202 includes a thumb button 204, which is an operative surface for the user to activate the hood release 202 (e.g., to slide the hood release 202 parallel to the primary axis of the holster 100) while gripping the implement, for example.

Pushing on the thumb button 204 slides the hood release 202 forward (e.g., in a direction parallel to the primary axis of the holster 100 toward the bottom of the holster 100). In various embodiments, the hood release 202 may be spring-loaded, or the like, such that releasing pressure on the thumb button 204 (and thus the hood release 202) causes or allows the hood release 202 to slide back toward the top opening of the holster 100, and return to its starting position.

In various embodiments, the hood release 202 is adjustable in length to accommodate various users. This allows the thumb button 204 to be closer or farther from the user's hand while the user grips the holstered implement. In the embodiments, as shown at FIGS. 7A-7D, the hood release 202 is comprised of at least 2 sections or rigid components, with the thumb button 204 integral to one of the sections (section 702).

Figure 7D:
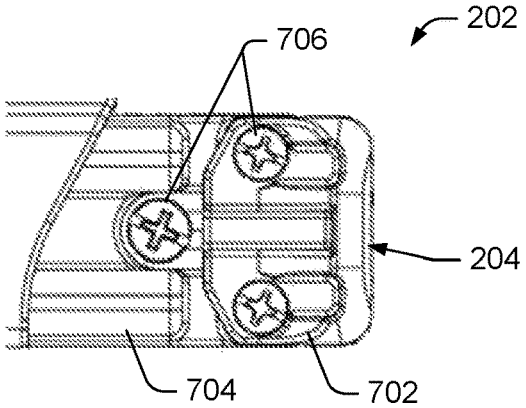
FIG. 7D shows a detail view of an adjustable hood release mechanism, according to an embodiment.

Referring to FIG. 7D, a detail view of an example adjustable hood release 202 is shown. A first section 702 is coupled to a second section 704 to form the hood release 202. In some embodiments, one or more coupling fasteners 706 (e.g., screws, bolts, etc.) may be loosened to adjust the length of the hood release 202, for example to extend or to retract the section 702 with respect to the section 704. Once the desired relative position of the section 702 with respect to the section 704 is achieved, the one or more fasteners 706 are tightened to fix the overall length of the hood release 202. Alternately, different lengths of the section 702 may be available, and the desired overall length of the hood release 202 may be achieved by selecting a section 702 with a desired length and coupling it to the section 704 using the one or more fasteners 706.

In an embodiment, as shown in FIGS. 1-4 and 7A-8, the holster 100 includes a thumb guard 114 disposed above the hood release 202 and thumb button 204. In the embodiment, the thumb guard 114 comprises a rigid feature integral to or coupled to the body 110, which guides the user's thumb to the thumb button 204 and hood release 202. This allows the user to find the thumb button 204 and hood release 202 by feel, without having to look at the holster 100. The thumb guard 114 also helps to position and keep the user's thumb on the thumb button 204 during activation of the hood release 202, helping to prevent the user's thumb from overshooting or sliding off the thumb button 204 during operation of the hood release 202.

In various embodiments, the position of the thumb guard 114 on the holster body 110 is adjustable to accommodate various users. This allows the thumb guard 114 to be closer or farther from the user's hand while the user grips the holstered implement, to complement the selected length of the hood release 202. For instance, the thumb guard 114 may be positioned farther from the user's hand when using a shorter hood release 202 and closer to the user's hand when using a longer hood release 202. In the embodiments, as shown at FIGS. 7A-7C, the thumb guard 114 includes a set of multiple mounting holes 708. The user can select from the multiple mounting holes 708 and couple the thumb guard 114 to the holster body 110 using the selected mounting holes 708 and one or more fasteners 710 to determine the position of the thumb guard 114 on the holster body 110.

Representative components of an example hood lock mechanism 102 are shown in FIGS. 5A-6B. In various implementations, primary features and components of the hood lock mechanism 102 include a hood 108, a pivot point of the hood 112, a hood release 202, a thumb button 204, a locking post 502, a locking post slot 504, a hood actuator 508, an offset pin 602 and an opening 604. In alternate embodiments, components of a hood lock mechanism 102 may have different shapes, sizes, and/or configurations, and remain within the scope of the disclosure. Further, a hood lock mechanism 102 may include fewer or more features and components, or alternate components to perform similar functions as described herein.

Figure 5A:
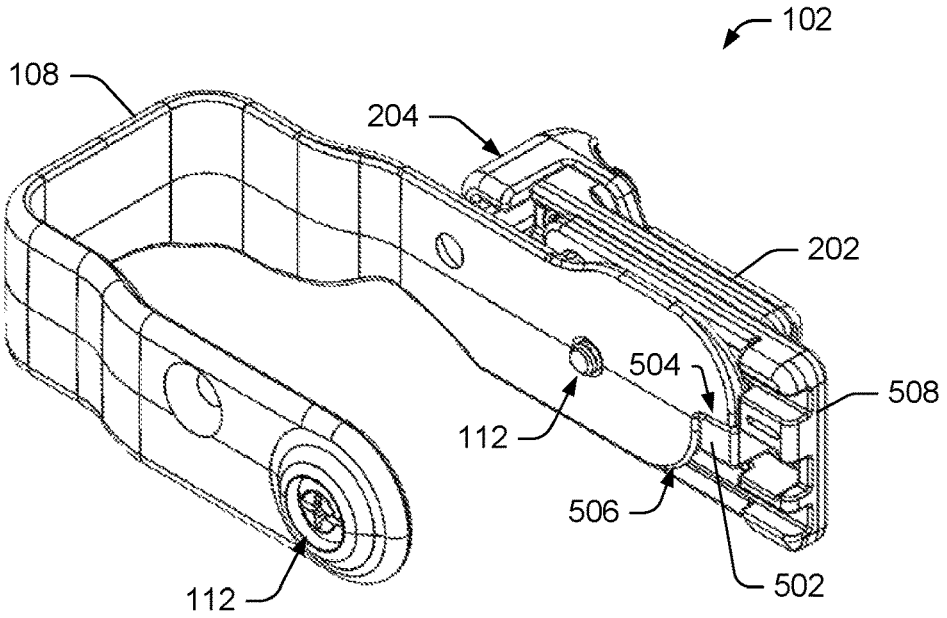
FIGS. 5A and 5B show two views of an example hood lock mechanism, according to an embodiment.
Figure 5B:
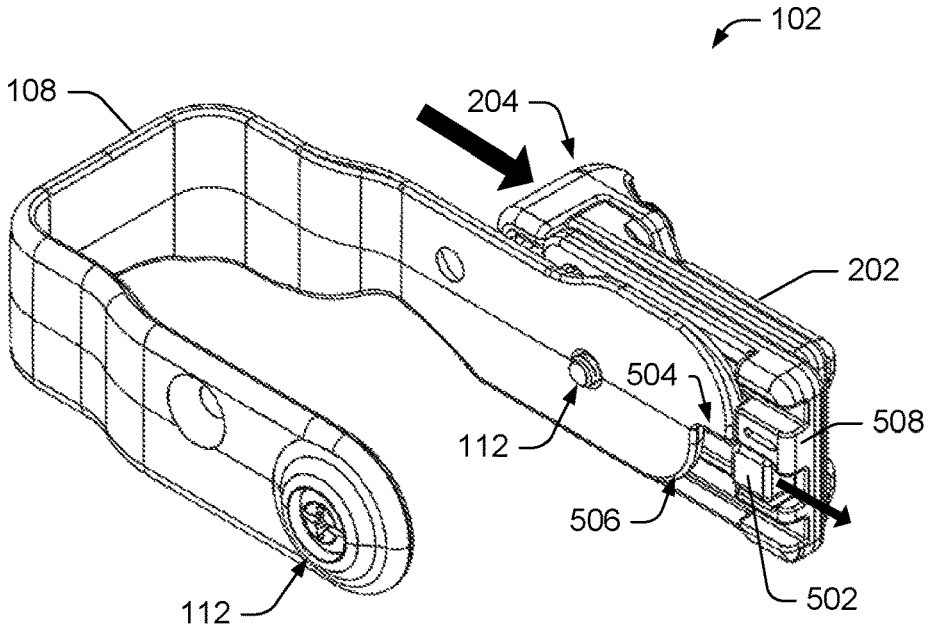

As shown in FIGS. 5A and 5B, the hood release 202 includes a locking post 502 coupled to or integral to the hood release 202. The locking post 502 protrudes from a portion of the hood release 202 to engage a portion of the hood 108. In an example, the locking post 502 engages a slot 504 (e.g., slot, recess, detent, aperture, opening, etc.) in the hood 108, and holds the hood 108 in the locked configuration until intentionally released. For instance, the locking post 502 prevents forces that act as a moment on the hood 108 from disengaging (e.g., pivoting) the hood 108. In an embodiment, the slot 504 is disposed at an edge of the hood 108 (such as one end of the U-shape of the hood 108) on one or both sides of the hood 108.

In some embodiments, as shown at FIGS. 5A and 5B a portion of the cross-sectional shape of the locking post 502 matches a shape of the slot 504, so that the locking post 502 engages the slot 504 in a close-fitting secure fashion, with minimal play. The cross-sectional shape of the locking post 502 and the matching shape of the slot 504 may have any shape that is convenient for the desired application (e.g., elliptical, polygonal, irregular, etc.). In an alternate embodiment, as also shown at FIGS. 5A and 5B, the hood 108 may be rounded or otherwise featured at one edge of the slot 504 (see for example the arrow at 506) with the rest of the slot 504 having a shape to match the shape of the locking post 502. The rounded edge 506 allows the hood 108 to be returned to the locked position without pushing the hood release 202. For instance, the rounded edge 506 of the hood 108 moves against the locking post 502 while the hood 108 is pivoted into the locked position at the slot 504.

Referring to FIGS. 5A and 5B, pushing on the thumb button 204 (with the user's thumb, for example) moves the hood release 202 forward in the direction of the primary axis, and since the locking post 502 is integral to or coupled to the hood release 202, also moves the locking post 502 out of the slot 504 in the hood 108. With the locking post 502 out of the slot 504, the hood 108 is allowed to pivot at the hood pivot points 112. FIG. 5A shows the hood release 202 in the locked position and the locking post 502 within the slot 504 in the hood 108, which holds the hood 108 in the locked configuration. FIG. 5B shows the hood release 202 in the unlocked position and the locking post 502 moved out of the slot 504 in the hood 108, which allows the hood 108 to move into the unlocked configuration.

Figure 6A:
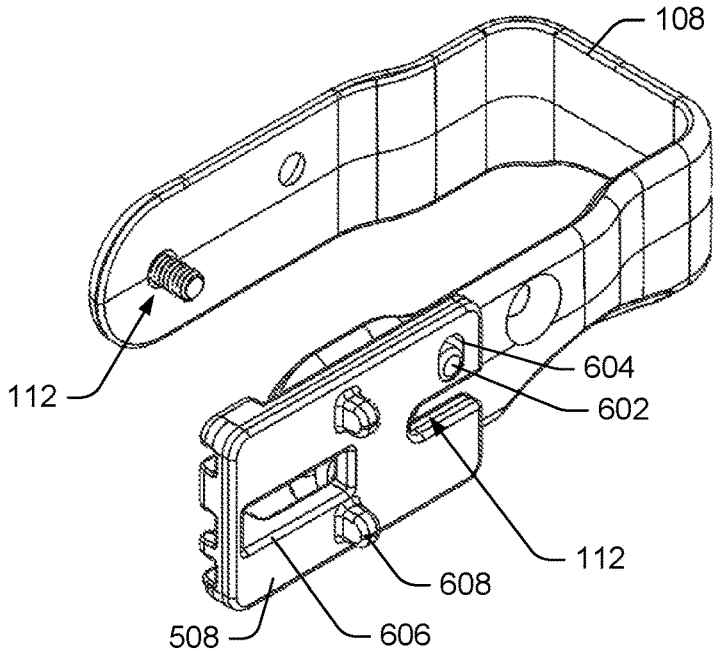
FIGS. 6A and 6B show two views of portions of an example hood lock mechanism, according to an embodiment.
Figure 6B:
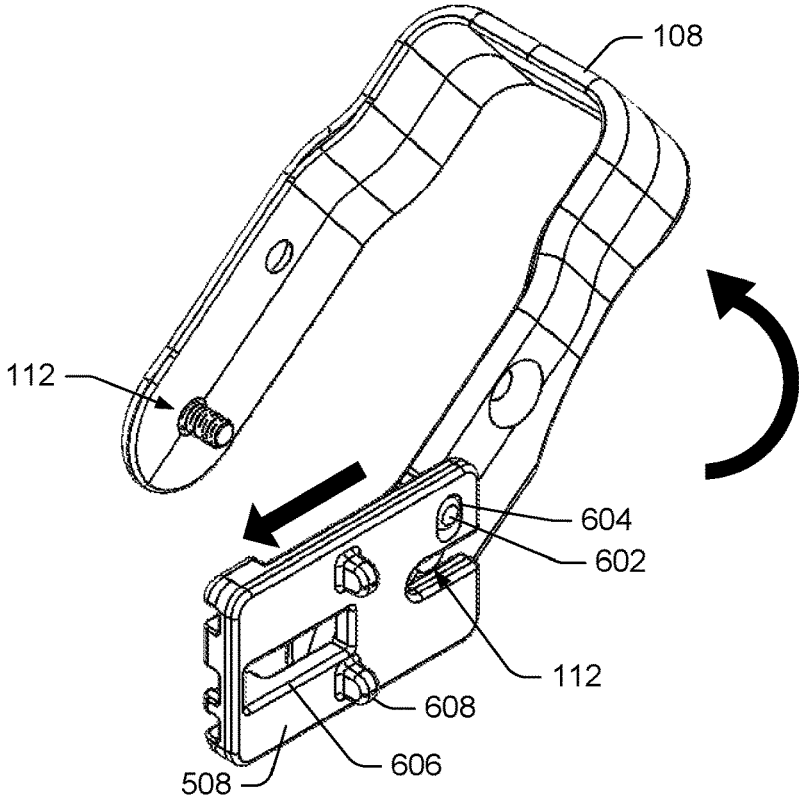

As shown in FIGS. 5A-6B, the hood lock mechanism 102 may also include a hood actuator 508 disposed between the hood release 202 and the hood 108. The hood actuator 508 is configured to move the hood 108 once the hood 108 is unlocked from the locking post 502. In an example, the hood actuator 508 comprises a substantially planar rigid component with one of its planar surfaces disposed next to one of the sides of the hood 108, so as to engage a portion of the hood 108. In an embodiment, as shown at FIGS. 6A and 6B, the hood 108 includes an offset pin 602 protruding outward from at least one side of the hood 108, and the hood actuator 508 includes an opening 604 positioned so that the pin 602 protrudes through the opening 604. With the pin 602 through the opening 604, moving the hood actuator 508 moves the hood 108.

In an example, since the hood actuator 508 is disposed between the hood release 202 and the hood 108, the hood actuator 508 also includes an opening or gap 606 for the locking post 502 to protrude through, so as to engage with the slot 504 of the hood 108. The hood actuator 508 also includes one or more features 608 to engage with the hood release 202, so that moving the hood release 202 a predetermined amount also moves the hood actuator 508. In some examples, mating features to the features 608 are disposed on an edge or on the surface of the hood release 202 facing the hood actuator 508.

As described above with respect to FIGS. 5A and 5B, once the locking post 502 is disengaged from the slot 504 in the hood 108 (by pushing the hood release 202 a first amount), the hood 108 is free to pivot. As shown at FIGS. 6A and 6B (the hood release 202 is not shown for clarity), pushing the hood release 202 further (an additional amount) pushes against the hood actuator 508 and moves hood actuator 508 forward also, which rotates the hood 108, pivoting the hood 108 in a forward pitch direction. The hood 108 pivots over the rear portion of the implement, and clears the implement for removal from the holster 100 (see FIG. 8).

For instance, as shown at FIGS. 6A and 6B, the offset pin 602 (or the like) is positioned offset a preselected distance from the pivot point 112 of the hood 108. The offset pin 602 is configured to protrude through the opening 604 in the hood actuator 508 that is mechanically coupled to the hood release 202. Pushing on the hood release 202 moves the hood actuator 508 in the same direction as the hood release 202 (e.g., forward, along the primary axis). Moving the hood actuator 508 forward (in a direction parallel to the primary axis of the holster 100) pulls on the offset pin 602 (which is trapped in the opening 604) and rotates the hood 108 on the hood pivot points 112. Thus, the forward motion of the hood actuator 508 is transferred into a rotation of the hood 108.

FIGS. 7A-7C show the action of the hood lock mechanism 102 along with the holster 100 and the example implement. FIG. 7A shows the hood lock mechanism 102 in the locked and closed configuration, with the hood 108 closed and the hood release 202 at the locked position (toward the top of the holster 100). As shown at FIG. 7B, moving the hood release 202 in a direction parallel to the primary axis by a first amount (by pushing on the thumb button 204) unlocks the hood 108, which remains in the closed configuration, but is now free to pivot.

As shown at FIG. 7C, moving the hood release 202 forward an additional amount (by pushing on the thumb button 204 an additional amount in the same direction) also moves the hood actuator 508 in the same direction. When the hood actuator 508 is moved forward, the opening 604 in the hood actuator 508 pulls on the offset pin 602 on the hood 108, causing the hood 108 to pivot into the open configuration. When the hood 108 is in the open configuration, the hood 108 clears the top opening of the holster 100 and the implement, allowing the implement to be removed from the holster 100.

In alternate embodiments, the mechanical connections between the hood release 202 and the hood actuator 508 and/or the hood actuator 508 and the hood 108 may be arranged differently, and with alternate components, but retain the same results (i.e., the pivot of the hood 108 due to the movement of the hood actuator 508). For instance, in alternate embodiments, the hood 108 may include an opening, or the like, and the hood actuator 508 may include a pin, or the like, and so forth.

The user can return the hood 108 to the closed configuration, to secure the implement in the holster 100, by rotating the hood 108 back to the unactuated (e.g., closed, locked, etc.) position. Moving the hood 108 into the closed configuration moves the hood actuator 508 and the hood release 202 back into the start position, via the offset pin 602 in the opening 604 (or like mechanical connection) of the hood actuator 508. This also moves the locking post 502 back into its start position, where it re-engages the slot 504 in the hood 108, locking the hood 108 in the closed configuration. In some cases, as discussed above, the hood 108 may include a rounded feature 506, or the like, so as to engage the locking post 502 to the slot 504 when the hood 108 is moved into the locked position, e.g., once the implement is holstered.

Example Ejection Port Lock Mechanism

Figure 9A:
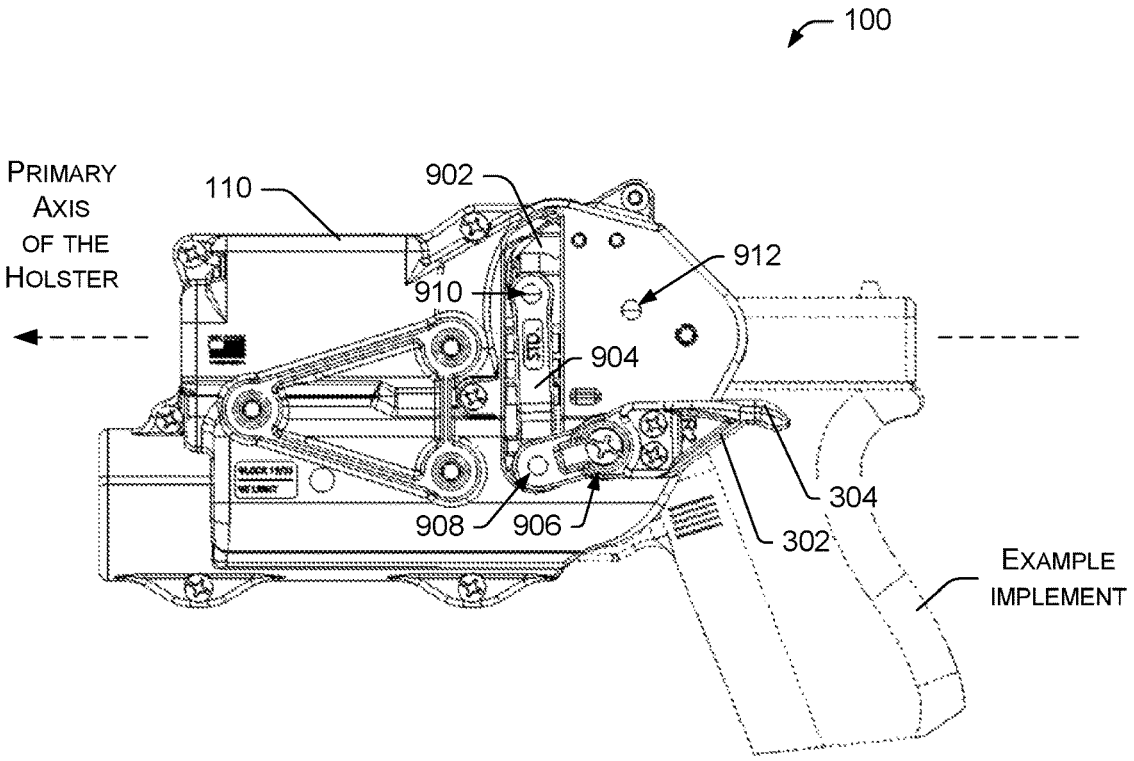
FIGS. 9A and 9B show two views of a holster with an example ejection port lock mechanism, according to an embodiment.
Figure 9B:
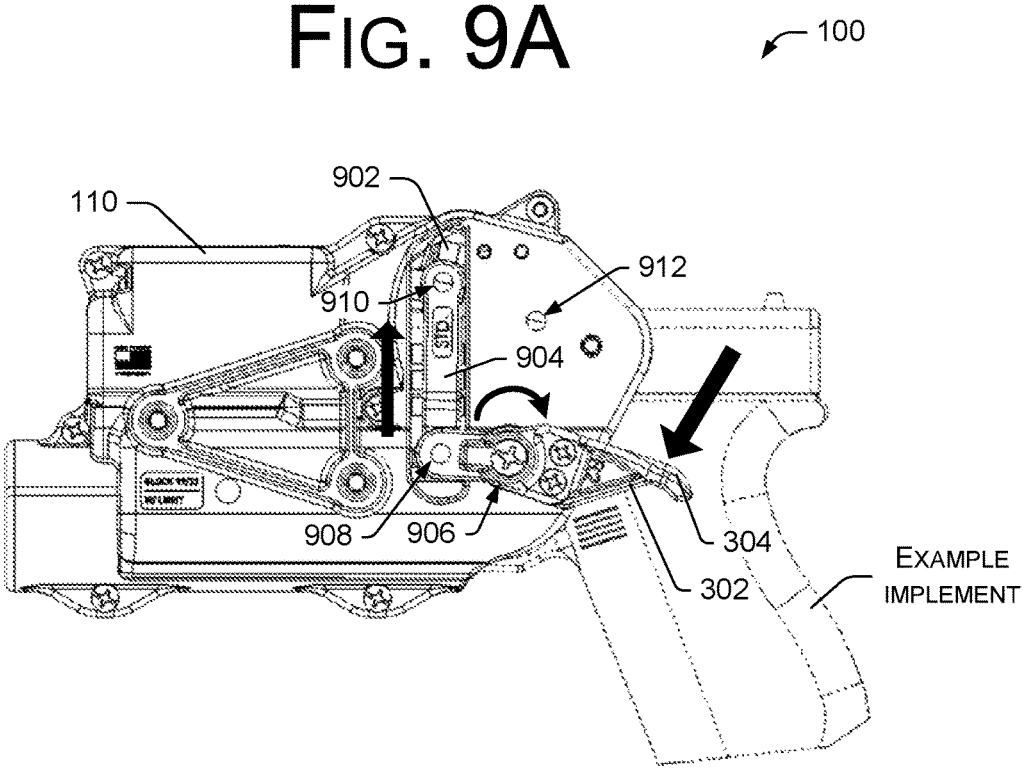
Figure 10A:
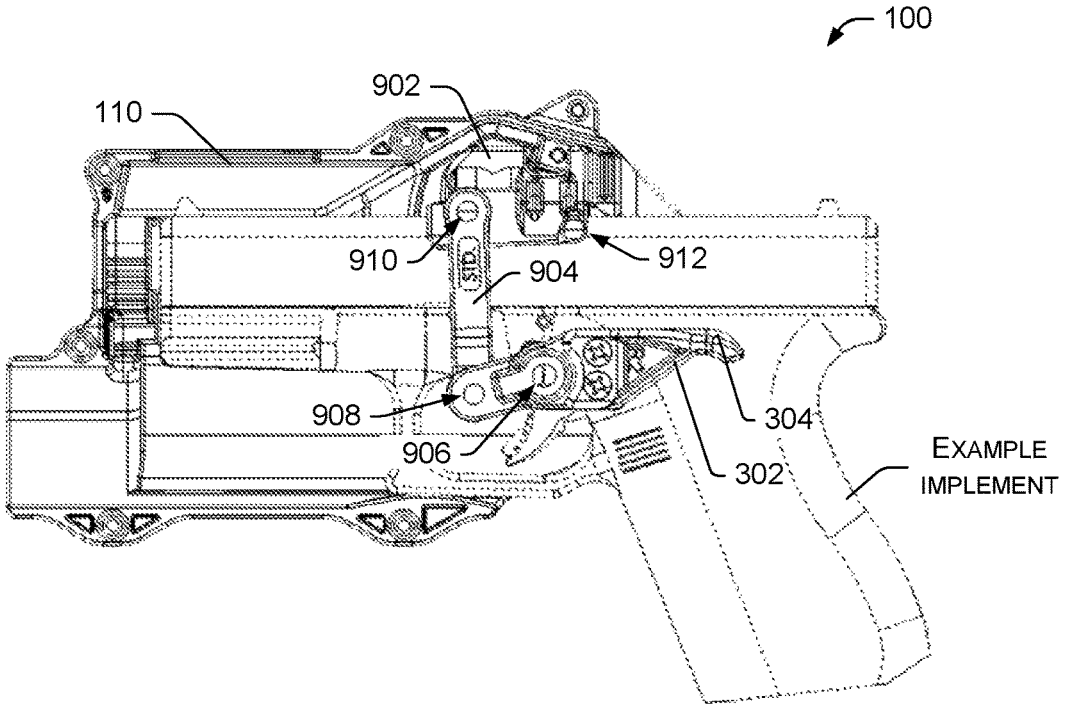
FIGS. 10A and 10B show two cut-away views of a holster with an example ejection port lock mechanism, according to an embodiment.
Figure 10B:
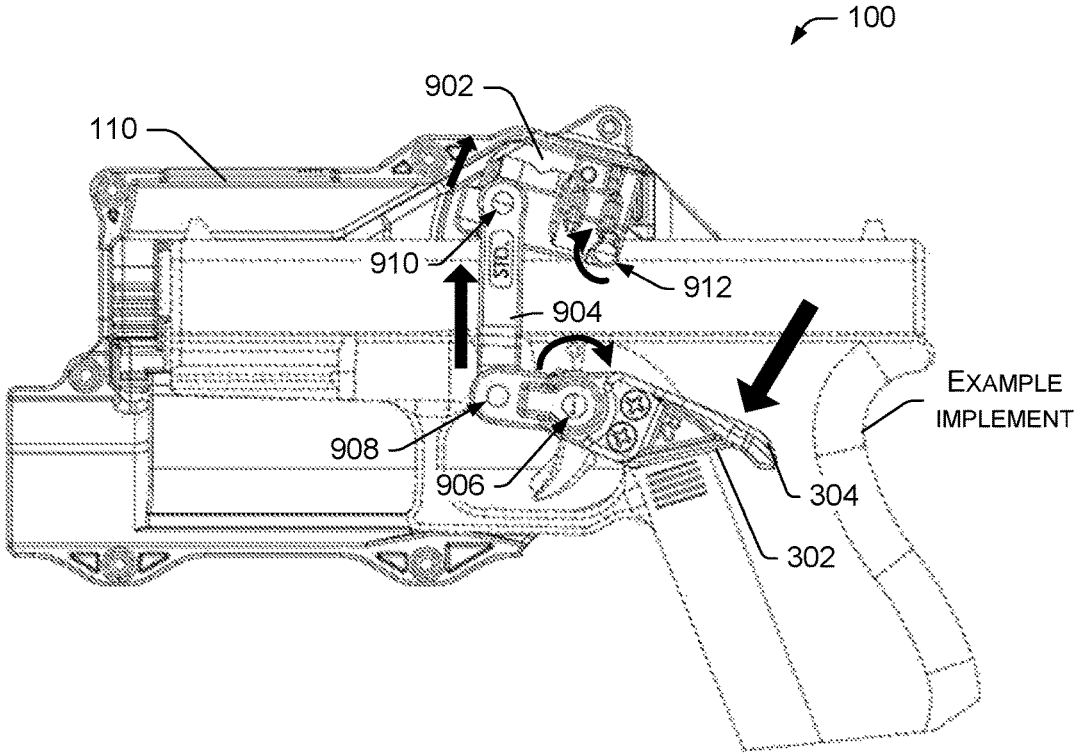
Figure 11A:
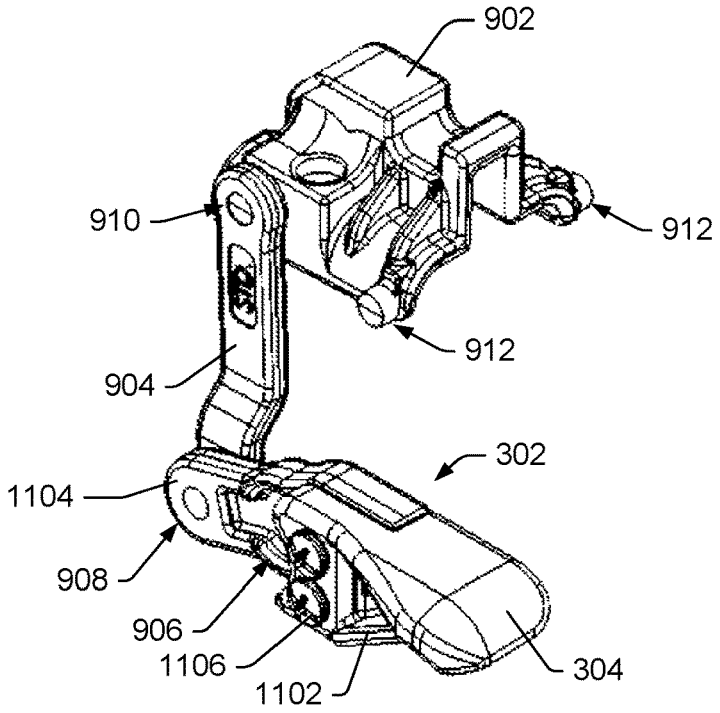
FIGS. 11A and 11B show two perspective views of an example ejection port lock mechanism, according to an embodiment.
Figure 11B:
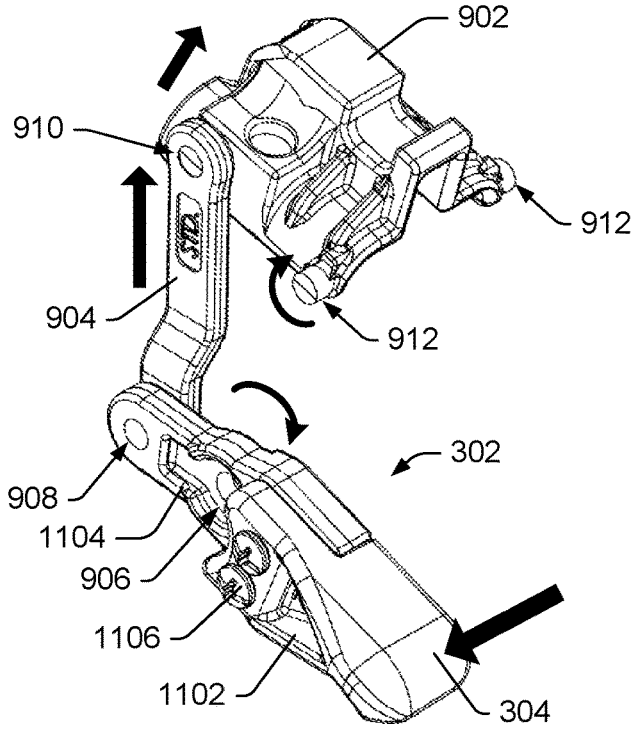

FIGS. 1-4, and 7A-10B illustrate embodiments of duty holsters 100 that include an ejection port lock mechanism ("EP Lock") 104. The duty holsters 100 may or may not also include other locking systems or components as well. FIGS. 7A-7C and 8 show an example of positioning an EP lock 104 latch release 302 on a holster 100 relative to a hood release 202, according to an embodiment. FIGS. 9A and 9B show example EP lock 104 components relative to the holster 100 (hood lock mechanism 102 components are removed for clarity). FIGS. 10A and 10B show example EP lock 104 components with the holster 100 cut away to show the EP lock 104 action in detail. FIGS. 11A-13C show example EP lock 104 components in isolation, for additional clarity.

In various embodiments, an EP Lock 104 includes a rigid latch member 902 that is pivotally coupled to the body 110 of the holster 100 near one edge of the latch member 902. The latch member 902 is configured and positioned to protrude into an opening or a recess of the implement (such as the ejection port of a handgun, see FIG. 15A for example) or to engage a portion of the implement while in a locked configuration.

Figure 14A:
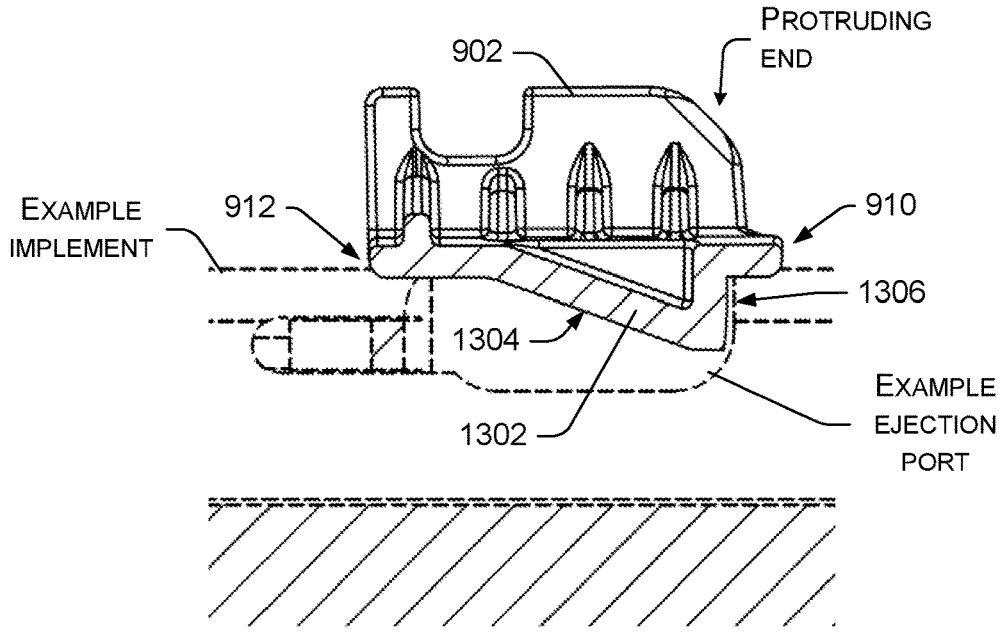
FIGS. 14A and 14B show two cut-away views of an example ejection port lock latch member, according to an embodiment.
Figure 14B:
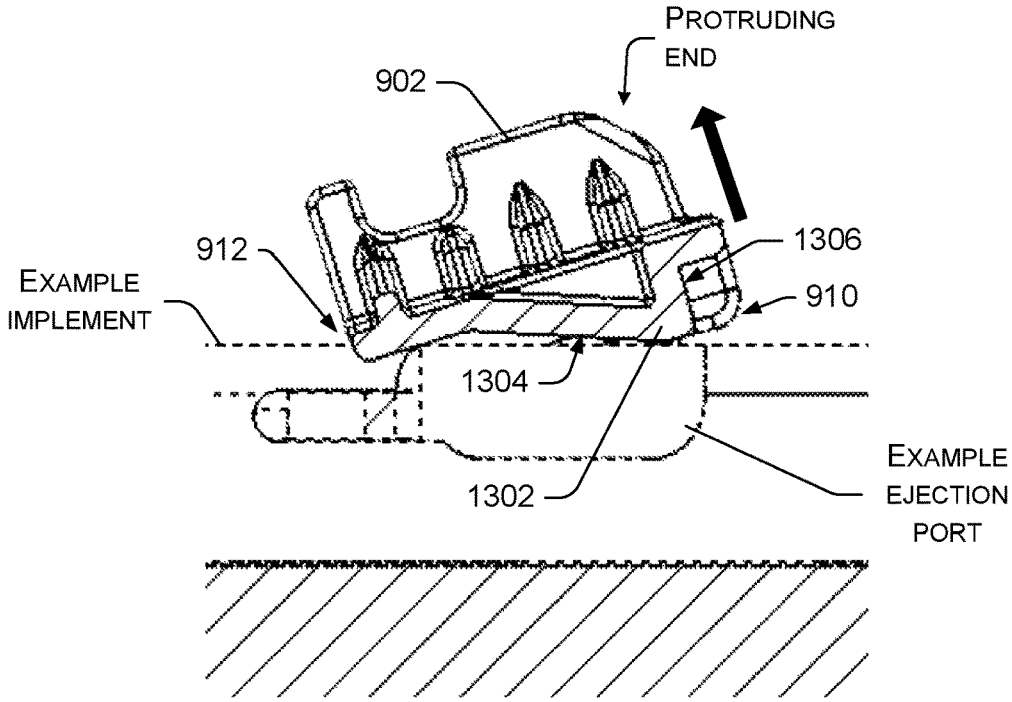

The latch member 902 is arranged to obstruct the removal of the implement from the holster 100 by securely engaging the implement when in the locked position, thus trapping the implement within the holster 100. FIGS. 14A and 14B show examples of a latch member 902 engaged (FIG. 14A) and disengaged (FIG. 14B) with an ejection port of a handgun, as an example. To release the implement, the latch member 902 is pivoted up and out of the recess of the implement, freeing the implement to be removed from the holster 100.

When the EP lock 104 is in the locked configuration, removal of the implement is not possible until the user intentionally deactivates the EP lock 104 (e.g., removes the latch member 902 from the opening or recess of the implement). The EP lock 104 may be used on a holster 100 in conjunction with a hood lock 102 or other locking system to increase the security of the implement, while allowing the user to intentionally deactivate all locking mechanisms (simultaneously or sequentially) to retrieve the implement from the holster 100.

As shown in FIGS. 8-13C, an example EP lock 104 may include a latch member 902, at least one connecting member 904, and a latch release 302. In alternate embodiments, components of an EP lock mechanism 104 may have different shapes, sizes, and/or configurations, and remain within the scope of the disclosure. Further, an EP lock mechanism 104 may include fewer or more features and components, or alternate components to perform similar functions as described herein.

The latch release 302 comprises the actuator for the EP lock 104, and may be comprised of a single rigid member or multiple rigid sections coupled together (as shown in FIGS. 11A-12B). The latch release 302 includes a thumb ledge 304, which is an operative surface for the user to activate the EP lock 104 while gripping the holstered implement, for example.

The latch release 302 is mechanically coupled to the latch member 902 via the connecting member 904. The connecting member 904 comprises a rigid connecting rod or connecting arm that is pivotally coupled to the latch release 302 at one end of the connecting member 904 and is pivotally coupled to the latch member 902 at a second end of the connecting member 904.

As shown at FIG. 8, the latch release 302 may be disposed on the same side of the holster 100 and proximate (e.g., nearby, close, immediately adjacent, neighboring, etc.) (in the example shown, just beneath) the hood release 202 (when equipped), with the thumb ledge 304 adjacent to the thumb button 204. After depressing the hood release 202 while gripping the implement, the user can slide the same thumb from the thumb button 204 and onto the thumb ledge 304 to pivot the latch release 302, thereby operating the hood release 202 and the latch release 302 in a single fluid motion. With both the hood release 202 and the latch release 302 in the unlocked configuration, the user can withdraw the implement from the holster 100 quickly and easily.

As shown in FIGS. 9A-10B, the latch release 302 is pivotally coupled to the body 110 of the holster 100 at pivot point 906, and may be operated by applying a force to the thumb ledge 304 (with the user's thumb, for instance). The latch release 302 comprises a rigid lever with the pivot point 906 between the thumb ledge 304 and a connection point 908 for the connecting member 904. FIGS. 9A and 10A show the EP lock 104 in the locked configuration. The latch release 302 is at rest with the thumb ledge 304 at the top extent of its travel.

Pushing on the thumb ledge 304, as shown in FIGS. 9B and 10B moves the thumb ledge 304 down and the opposite end of the latch release 302 (e.g., at connection point 908) upward as the latch release 302 pivots at the pivot point 906. A first end of the connecting member 904 is pivotally coupled to the end of the latch release 302 opposite the thumb ledge 304 (at connection point 908), which causes the connecting member 904 to move upward as well.

In various embodiments, the latch release 302 is adjustable in length to accommodate various users. This allows the thumb ledge 304 to be closer or farther from the user's hand while the user grips the holstered implement. In the embodiments, as shown for example at FIGS. 11A-12B, the latch release 302 is comprised of at least 2 sections or rigid components, with the thumb ledge 304 integral to one of the sections (section 1102).

Figure 12A:
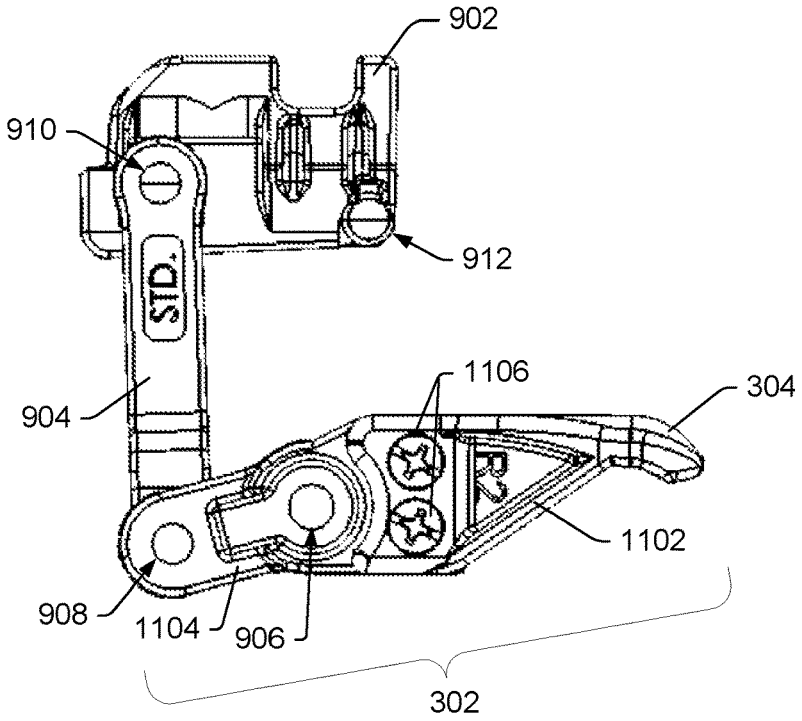
FIGS. 12A and 12B show two cut-away views of an example ejection port lock mechanism, according to an embodiment.
Figure 12B:
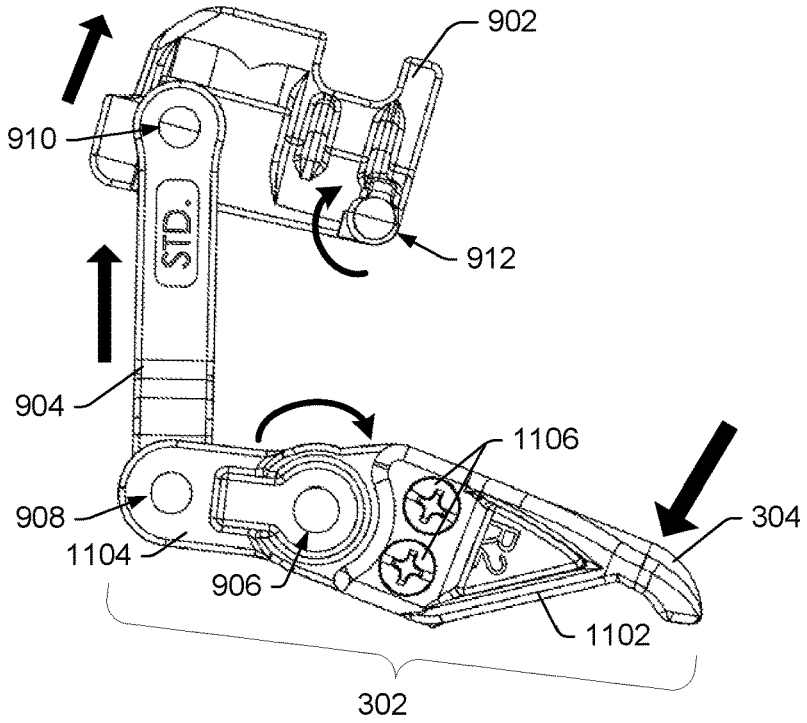

Referring to FIG. 12A, a plan view of an example adjustable latch release 302 is shown as part of the example assembly. A first section 1102 is coupled to a second section 1104 to form the latch release 302. In some embodiments, one or more coupling fasteners 1106 (e.g., screws, bolts, etc.) may be used to couple the first section 1102 to the second section 1104. In the embodiments, different lengths of the section 1102 may be available, and the desired overall length of the latch release 302 may be achieved by selecting a section 1102 with a desired length and coupling it to the section 1104 using the one or more fasteners 1106. Alternately, the one or more fasteners 1106 may be loosened to adjust the length of the latch release 302, for example to extend or to retract the section 1102 with respect to the section 1104. Once the desired relative position of the section 1102 with respect to the section 1104 is achieved, the one or more fasteners 1106 are tightened to fix the overall length of the latch release 302.

As shown at FIGS. 10A, 11A, 12A, and 14A, prior to pushing on the thumb ledge 304 (while the latch release 302 is in the locked configuration), the latch member 902 is positioned down with a protruding portion 1302 of the latch member 902 protruding into the opening or recess of the implement (e.g., the ejection port of a handgun, etc., see FIG. 14A). With the protruding portion 1302 in the recess of the implement, the implement is trapped and unable to be removed from the holster 100.

Figure 13A:
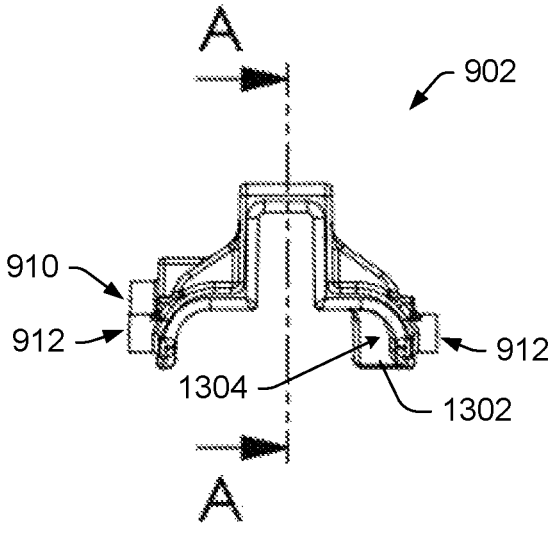
FIGS. 13A-13C show views of an example latch member of an ejection port lock mechanism, according to an embodiment.
Figure 13B:
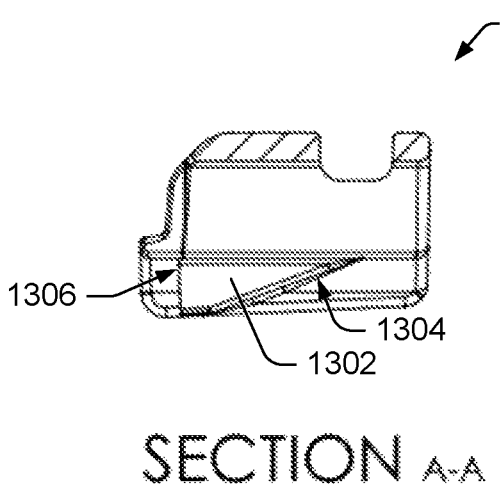
Figure 13C:
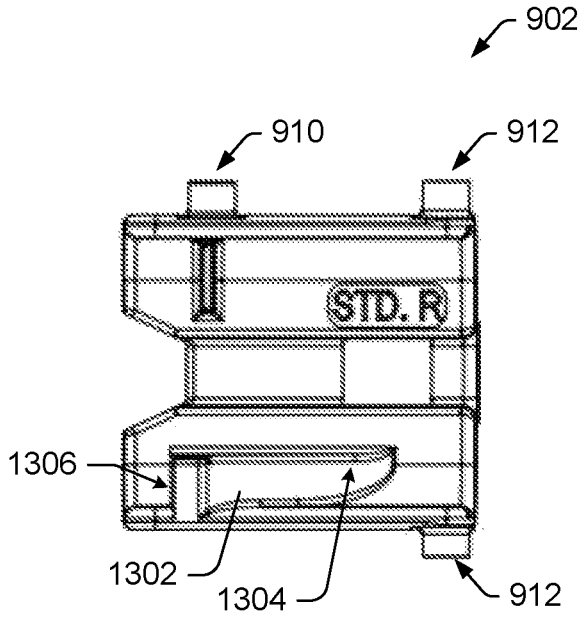

In an implementation, as shown at FIGS. 13A-13C, the latch member 902 comprises a saddle-shaped rigid member that is shaped and configured to be disposed over a portion of the implement (e.g., over the top of the barrel of a handgun). The latch member 902 is positioned within the holster 100 at the front of the holster 100 so that the protruding portion 1302 on the underside of the latch member 902 will engage with the opening or recess (e.g., ejection port) of the implement when the implement is holstered and the latch member 902 is in the locked position. Accordingly, the protruding portion 1302 may be disposed on one side of the underside of the latch member 902 (as shown in FIG. 13C), in the case of a handgun holster 100. In alternate implementations, where the holster 100 is intended to enclose other implements, the latch member 902 may have multiple protruding portions 1302. Further, the latch member 902 and/or the protruding portion(s) 1302 may have different shapes and/or configurations, based on the intended implement and the features, recesses, openings, etc. intended to be engaged by the latch member 902.

The latch member 902 is pivotally coupled to the second end of the connecting member 904 at the protruding end or edge of the latch member 902 (at pivot point 910), and pivotally coupled to the holster body 110 at pivot points 912 at or near an opposite end of the latch member 902 (see FIG. 13C, for example). This allows the protruding end of the latch member 902 to be raised and lowered while pivoting about a fixed axis at pivot points 912. In an embodiment as shown at FIGS. 9A-10B, the connecting member 904 is coupled to the latch member 902 on a side opposite the protruding portion 1302. In alternate embodiments, the connecting member 904 may be coupled to the latch member 902 on the same side as the protruding member 1302 or a connecting member 904 may be coupled to the latch member 902 on both sides of the latch member 902.

When the thumb ledge 304 is pushed and the connecting member 904 moves upward, the connecting member 904 pushes the protruding end of the latch member 902 upward as well, causing the latch member 902 to pivot in a negative "pitch" direction at the pivot points 912 on an axis normal to the primary axis of the holster 100 (e.g., parallel to the axis of rotation of the hood 108), which moves the protruding portion 1302 out of the opening or recess of the implement. This defines the unlocked configuration of the EP lock 104, and the implement is unrestrained by the EP lock 104 in this configuration.

While the thumb ledge 304 is pushed, the implement may be removed from the holster 100. Once the thumb ledge 304 (and the latch release 302) is released, the EP lock 104 components return to the locked configuration. For example, the latch release 302 (and/or other EP lock 104 components) may be spring-loaded, or the like, causing the latch release 302 to return to its starting position once force is removed from the thumb ledge 304.

As shown at FIGS. 13A-14B, the protruding portion 1302 of the latch member 902 may include a ramp section 1304 that allows the implement to be inserted into the holster 100, moving the protruding end of the latch member 902 up and out of the way as the implement passes. Accordingly, the latch member 902 may be spring-loaded or the like. The spring-loading forces the protruding end of the latch member 902 back down, and causes the protruding portion 1302 of the latch member 902 to move into the opening or recess (e.g., ejection port) when the implement is fully holstered.

The latch member 902 also includes a front edge 1306 (e.g., a blocking edge) that prevents the implement from being removed while the latch member 902 is in the locked position (see FIG. 14A), since the front edge 1306 hits against a wall of the opening or recess of the implement when the implement is pulled, trapping the implement while the latch member 902 is in the locked position. In various embodiments, the front edge 1306 may be planar or contoured and may include features to assist in holding the implement within the holster 100.

In alternate implementations, two or more connecting members 904 may be used to link the latch release 202 to the latch member 902 and to activate the latch member 902. Alternate embodiments may also use additional or alternate components to accomplish the action of moving the latch member 902 as described.

Example Passive Retention Mechanism

Figure 15A:
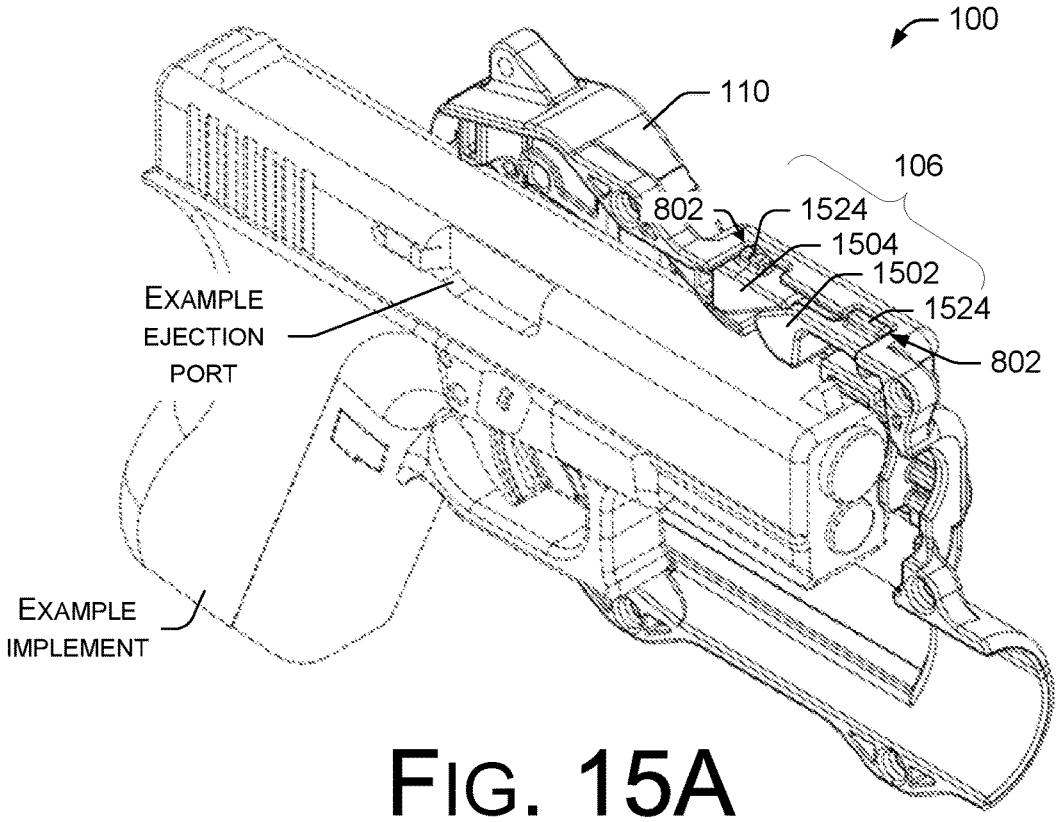
FIG. 15A shows a cut-away view of an example duty holster with a passive retention mechanism, according to an implementation.
Figure 15B:
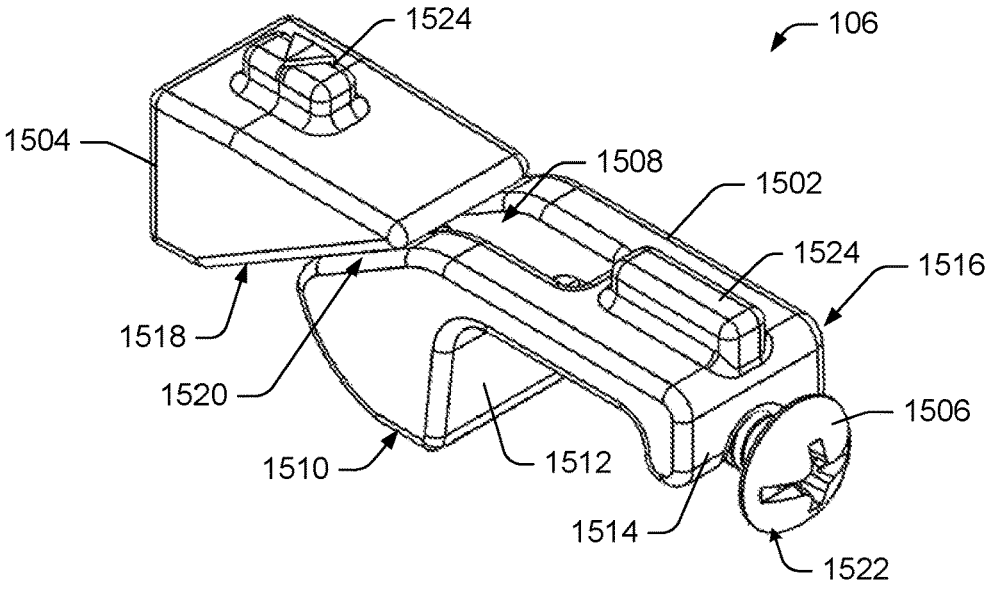
FIG. 15B shows a perspective view of an example passive retention mechanism, according to an embodiment.
Figure 16A:
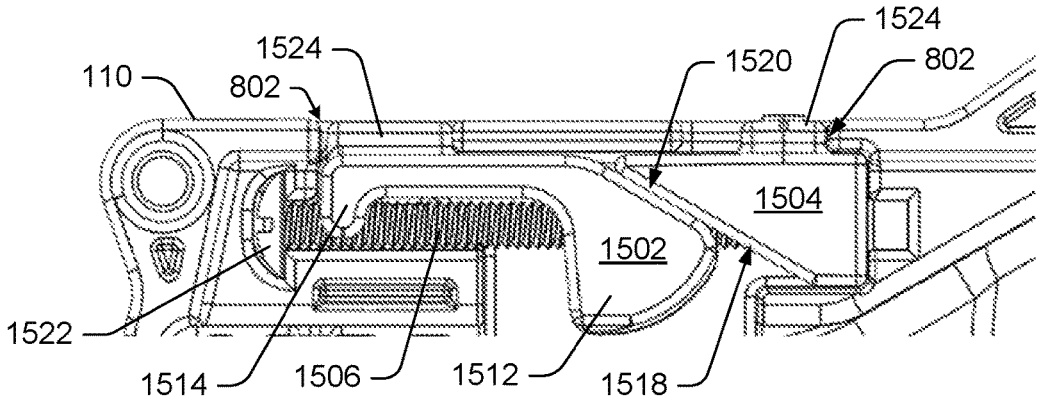
FIGS. 16A and 16B show two views of example operation of a passive retention mechanism within a holster, according to an embodiment.
Figure 16B:
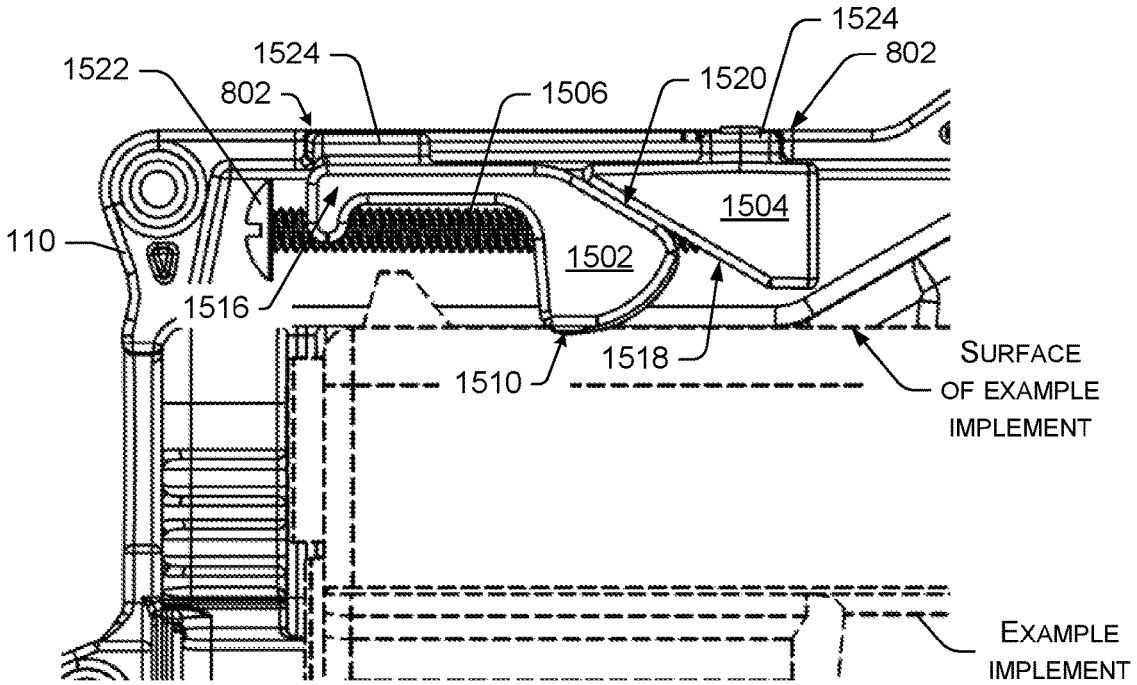

FIGS. 15A and 16A-16B illustrate embodiments of duty holsters 100 that include a passive retention system ("PRS") 106, an example of which is also shown at FIG. 15B. The example PRS 106 includes a retention member 1502 that is configured to apply pressure to a surface of the implement (such as the slide of a handgun, for example). The PRS 106 is arranged to assist in retaining the implement within the holster 100 until it is intentionally withdrawn, by increasing the friction of the holster 100 on the implement. The PRS 106 works independently from other locking systems or components that may be included with the duty holster 100.

In an example, the PRS 106 includes a retention member 1502, a pusher member 1504, and an adjustment screw 1506. In alternate embodiments, the PRS 106 may include additional or alternate components performing the functions described herein. The retention member 1502 comprises a rigid component having an elongated opening 1508 through part of the length of the retention member 1502 and a friction surface 1510 on a contact portion 1512 of the retention member 1502 below the opening 1508. The adjustment screw 1506 is captured at a pivot portion 1514 of the retention member 1502 and extends through the opening 1508 of the retention member 1502 where it is threaded into the pusher member 1504. The elongated shape of the opening 1508 allows the retention member 1502 to pivot while providing room for the screw 1506 as it passes through the opening 1508.

As shown in FIGS. 15A and 16A-16B, the retention member 1502 is configured so that the friction surface 1510 of the contact portion 1512 is positioned in contact with the implement while the implement is holstered. A pivot point 1516 at the pivot portion 1514 is disposed at an opposite end of the retention member 1502 from the contact portion 1512. In an embodiment, the retention member 1502 pivots at the pivot point 1516 to apply pressure to the implement at the friction surface 1510. For example, pivoting the retention member 1502 at the pivot point 1516 causes the contact portion 1512 to increase or decrease pressure on the implement at the friction surface 1510. In various embodiments, the friction surface 1510 may include textures or features and/or a different material, or the like, to enhance the gripping capability of the friction surface 1510.

Using a ramped surface 1518, the pusher 1504 pushes against the retention member 1502 to rotate the retention member 1502 about its pivot point 1516, so as to apply pressure to the implement. In various embodiments, the retention member 1502 also includes a ramped surface 1520. The ramped surface 1518 of the pusher 1504 slides against the ramped surface 1520 of the retention member 1502 to pivot the retention member 1502.

The adjustment screw 1506 is threaded into the pusher 1504 at the ramped surface 1518, and is rotated to determine the amount of pressure the pusher 1504 applies to the retention member 1502. When the screw 1506 is tightened (e.g., rotated in a first direction) a distance between the head 1522 of the screw 1506 and the pusher 1504 is decreased as the screw 1506 is threaded further into the pusher 1504. The decrease in distance causes the ramped surface 1518 of the pusher 1504 to move against the ramped surface 1520 of the retention member 1502, forcing the retention member 1502 to pivot downward. Thus, the pusher 1504 pushes the retention member 1502 downward and against the implement, increasing the pressure on the implement.

Pressure on the implement is reduced by loosening the screw 1506 (e.g., rotating the screw 1506 in an opposite direction), which increases a distance between the head 1520 of the screw 1506 and the pusher 1504 as the screw 1506 is backed out of the pusher 1504. The increase in distance causes the pusher 1504 to reduce pressure on the retention member 1502, allowing the retention member 1502 to pivot away from the implement and the contact portion 1512 to reduce pressure on the implement.

In an embodiment, the pusher 1504 and/or the retention member 1502 may have one or more locating fins 1524 on their surface, which may be used to locate and secure them to the holster body 110. As shown in FIGS. 15A and 16A-16B, the locating fins 1524 may be inserted into (or otherwise engage) engagement points within the interior of the holster body 110. The locating fins 1524 and engagement points may be effective to prevent the pusher 1504 and/or the retention member 1502 from moving within the body 110, especially as the tension of the retention member 1502 on the implement is increased or decreased.

In various implementations, additional or alternate components may be used to accomplish the action of applying pressure to the retention member 1502 as described.

Example Sight Cover Mechanism

Figure 17A:
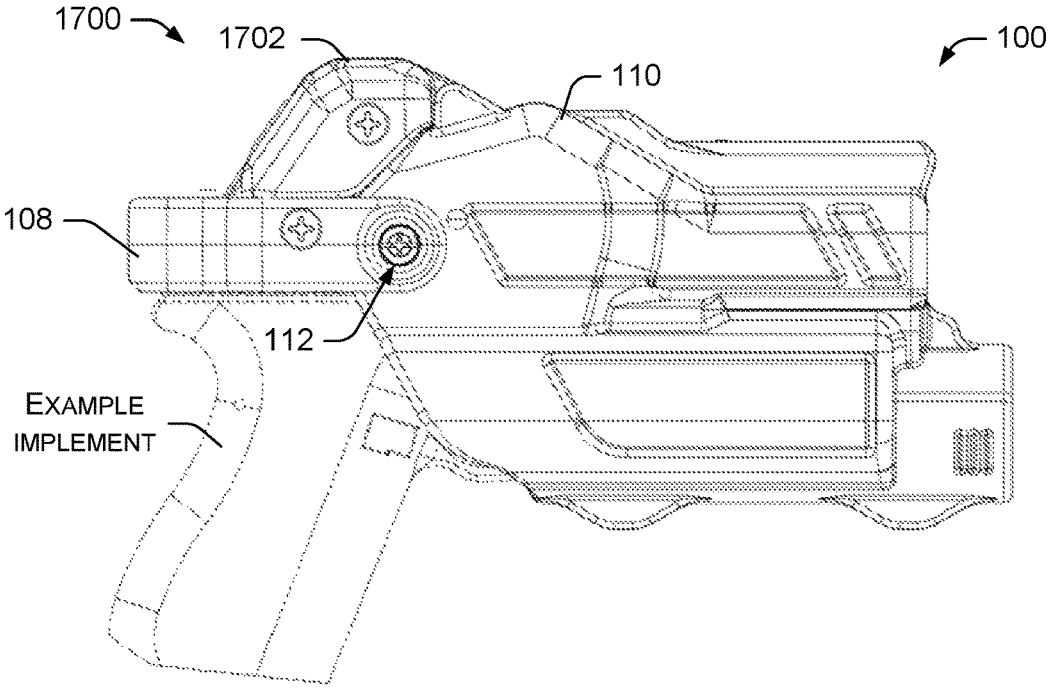
FIG. 17A shows a side view of an example duty holster, according to an implementation. The example holster includes at least a hood lock and a sight cover.
Figure 17B:
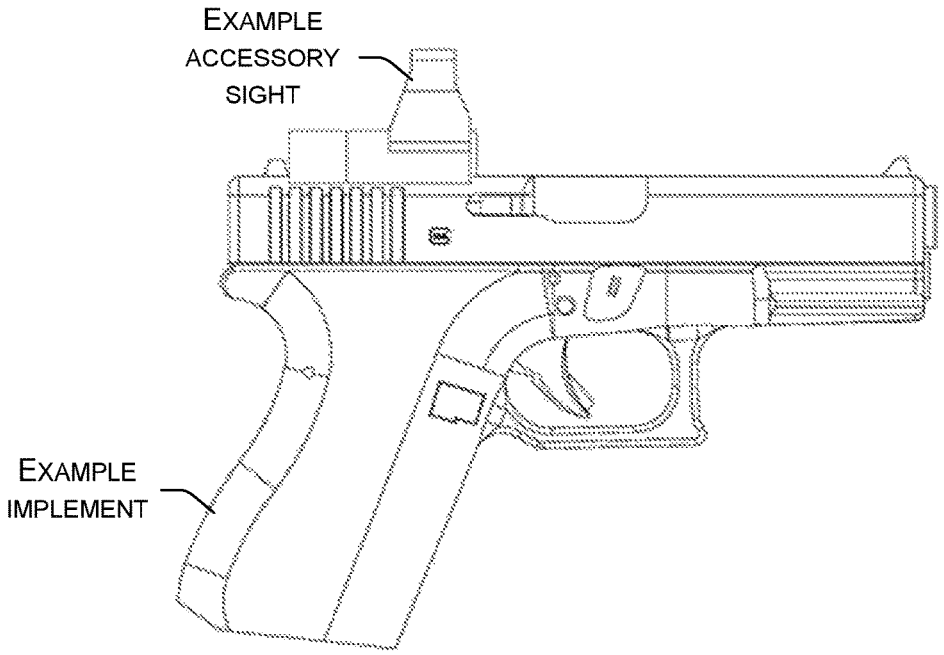
FIG. 17B shows a side view of an example implement with a reflex sight.
Figure 18A:
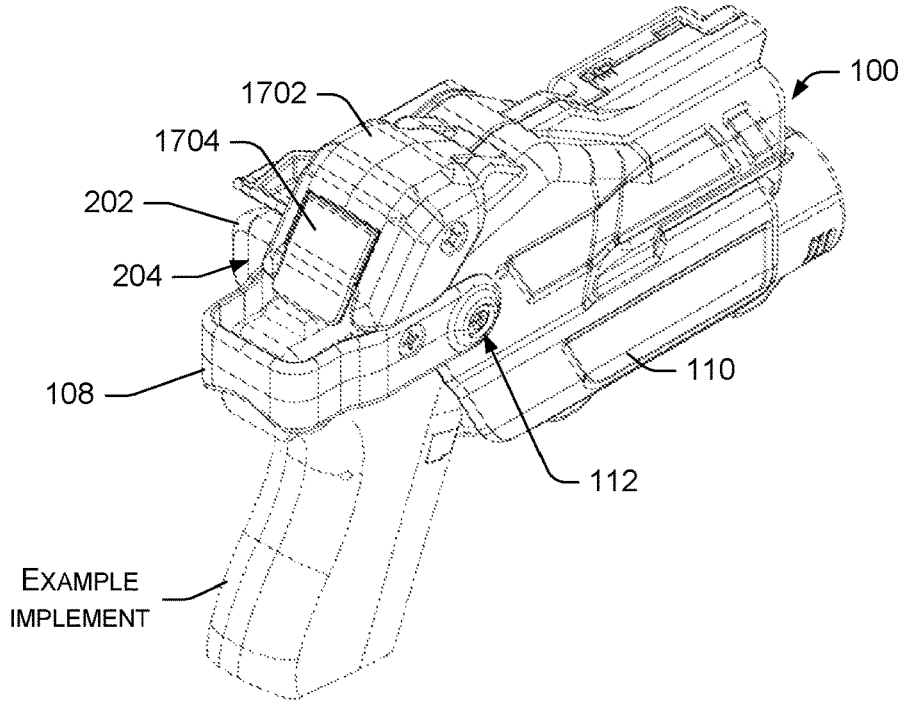
FIG. 18A shows a perspective view of an example duty holster, according to an implementation. The example holster includes at least a hood lock and a sight cover, both in a closed configuration.
Figure 18B:
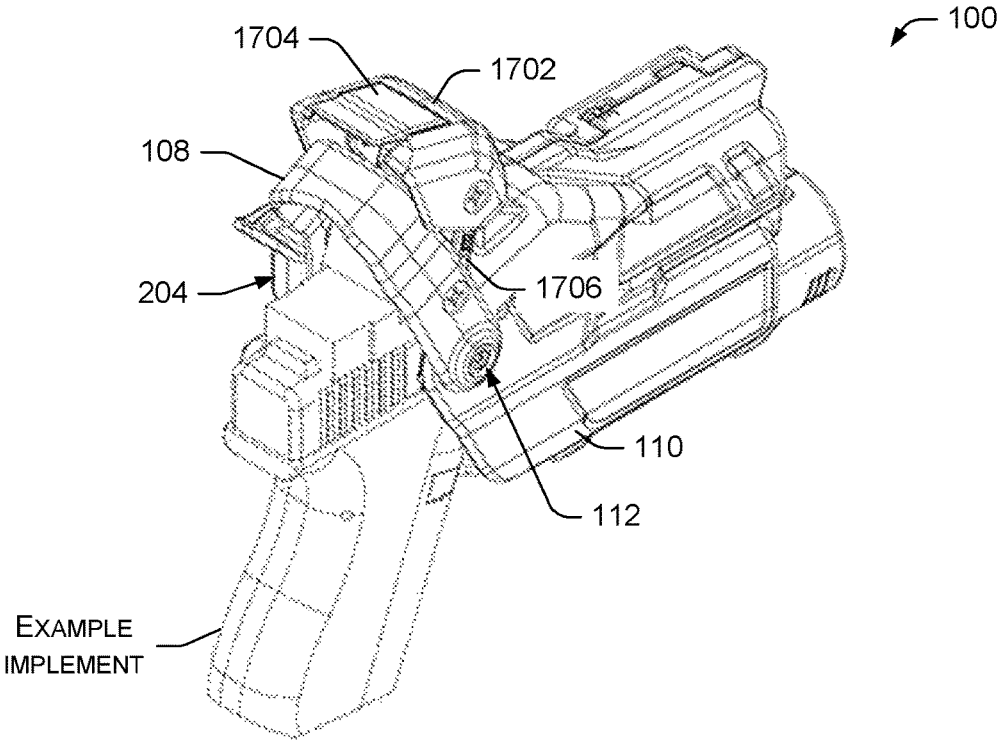
FIG. 18B shows a perspective view of an example duty holster, according to an implementation. The example holster includes at least a hood lock and a sight cover, both in an open configuration.

FIGS. 17A and 18A-18B illustrate embodiments of duty holsters 100 that include a sight cover system 1700. The sight cover system 1700 includes components to ensure coverage of an implement (such as a handgun, for example) having an accessory sight attached, such as a reflector or "reflex" sight. An example of an implement with an accessory sight is shown at FIG. 17B. Since the accessory sight adds overall dimensions to the implement (as shown in FIG. 17B), particularly at the top rear portion of the implement, the sight cover system 1700 accommodates the added dimensions while working with a hood locking system 102 if included on the duty holster 100.

It can be important to ensure that an accessory sight is fully enclosed and protected from debris or damaging contact. An example sight cover system 1700 includes a sight cover 1702. As shown in FIG. 17A, a sight cover 1702 may comprise a rigid covering that fully encloses the accessory sight, including part of the top rear portion of the implement. Accordingly, many sizes of sight covers 1702 may be interchangeable for use with the duty holster 100 to accommodate many different accessory sights.

Referring to FIG. 18A, the sight cover 1702 and hood locking system 102 are shown in the closed and locked configuration. In the closed configuration, the sight cover 1702 and the hood 108 are covering portions of the implement and the accessory sight for protection and security of the implement and the accessory sight. In an implementation, as shown, the sight cover 1702 may include a flexible cover flap 1704, coupled by one or more edges of the flap 1704 to the sight cover 1702. The flexible cover flap 1704 can accommodate small to large accessory sights by flexing or bending to fit over the sight. The flexible cover flap 1704 can eliminate gaps between the flap 1704 and the sight cover 1702 regardless of the size of the sight.

Referring to FIG. 18B, the sight cover 1702 and hood locking system 102 are shown in the open and unlocked configuration. As shown, the sight cover 1702 can be coupled to the hood 108 by one or more rigid linkage members 1706. The linkage members 1706 can be pivotally coupled to the hood 108 and to the sight cover 1702, and the sight cover 1702 can be hinged to the holster body 110 (at a front portion of the sight cover 1702) so that the sight cover 1702 is opened when the hood 108 is raised. The hood 108 may be raised as described above, for example (e.g., with a hood release 202, etc.). This opens the sight cover 1702 and the hood 108 so that the implement can be withdrawn from the holster 100.

After re-holstering the implement, the hood 108 can be lowered to the closed and locked position. Due to the one or more linkage members 1706, the sight cover 1702 is lowered with the hood 108 into the closed position.

Many of the rigid components of the hood lock system 102, ejection port lock system 104, passive retention system 106, and/or sight cover system 1700 may be comprised of injection molded polymers, such as Nylon and the like. Alternate materials may include fiberglass, carbon fiber, other composites, metals, alloys, and so forth. Materials may be selected for desired strength combined with light weight. Flexible components may be comprised of flexible polymers, TPEs, aramids, ballistic materials, natural or synthetic leathers, or the like.

The illustrations of FIGS. 1-18B are not intended to be limiting. While a handgun holster is illustrated, various other types of implement holsters, cases, carriers, and the like are also within the scope of the disclosure. Further, the design of the holster as well as the design of the various locking systems may vary. Other locking devices and techniques are also within the scope of the disclosure. While predominantly right-handed examples of holsters and associated locking mechanisms are illustrated, left-handed embodiments are also included, with appropriate adjustments in mechanical attributes, as appropriate for left-handed versions (e.g., placement of actuators, linkages, etc.).

Although various implementations and examples are discussed herein, further implementations and examples may be possible by combining the features and elements of individual implementations and examples.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing the disclosed techniques, systems, and devices. Further, individual features of various embodiments may be combined to form other embodiments not specifically described.

What is claimed is:

1. A holster for an implement, comprising:

a shell configured to enclose at least part of an implement; and a hood lock mechanism including:

a hood comprising a curved rigid cover pivotally coupled to the shell at an opening of the shell, such that the hood obstructs the opening of the shell while the hood is in a locked configuration and the hood is clear of the opening of the shell while the hood is in an unlocked configuration;

a hood release device slideably coupled to the shell and arranged to unlock the hood when moved linearly a first extent in a first direction and to move the hood into the unlocked configuration when moved linearly a second extent in the first direction, the hood release device including a post protruding from a surface of the hood release device, configured to engage a slot in the hood while the hood is in the locked configuration, the hood release device arranged to move the post out of the slot when moved the first extent; and an actuation mechanism comprising a substantially planar component disposed between a portion of the hood and the hood release device and mechanically coupled to the hood and to the hood release device, the actuation mechanism configured to move in the first direction and rotate the hood into the unlocked configuration when the hood release device is moved the second extent.

2. The holster of claim 1, wherein one of the hood or the actuation mechanism includes an offset pin, disposed offset a preselected distance from a pivot point of the hood at the shell, and the other of the hood or the actuation mechanism includes an opening, wherein the pin protrudes through the opening, and wherein the actuation mechanism rotates the hood via the opening operating on the pin or the pin operating on the opening while moving in the first direction or moving in a direction opposite the first direction.

3. The holster of claim 1, wherein the hood rotates on an axis normal to a primary axis of the holster running from a top opening of the shell for inserting the implement, through a length of the shell, to a bottom of the shell, and wherein the hood release is slideably coupled to the shell and moves in a direction parallel to the primary axis.

4. The holster of claim 1, wherein the hood release device is comprised of at least two rigid sections coupled together with one or more fasteners, with a thumb button integral to one of the rigid sections, and wherein the hood release device is adjustable in length by adjusting a relative position of the at least two rigid sections.

5. The holster of claim 1, wherein the hood release device is comprised of at least two rigid sections coupled together with one or more fasteners, with a thumb button integral to one rigid section, and wherein the hood release device is adjustable in length by replacing the one rigid section having the thumb button with a longer or a shorter rigid section having a thumb button.

6. The holster of claim 1, wherein the hood includes a curved portion at an edge of the hood leading to the slot, the hood configured to automatically lock when moved to the locked configuration based on the curved portion at the edge of the hood.

7. The holster of claim 1, further comprising an ejection port lock system, including:

a latch member pivotally coupled to the shell at a first end of the latch member, and having a protruding portion on an underside of the latch member configured to engage an opening or a recess of an implement while the latch member is in a locked configuration;

a rigid connecting arm pivotally coupled to the latch member at a second end of the latch member; and a latch release lever pivotally coupled to the connecting arm at a first end of the latch release lever and having an operating surface at a second end of the latch release lever, the latch release lever pivotally coupled to the shell at a pivot point between the first end and the second end of the latch release lever, the connecting arm is arranged to move in a first direction when the latch release lever is pivoted at the pivot point by moving the operating surface in a second opposite direction, causing the connecting arm to pivot the latch member into an unlocked configuration.

8. The holster of claim 7, wherein the latch member comprises a saddle-shaped rigid member that is shaped to fit over a slide of a handgun, and wherein the protruding portion is shaped to fit within an ejection port of the handgun.

9. The holster of claim 7, wherein the latch member is disposed within an interior of the holster, the latch member having a pivot point on each of two sides of the holster and arranged to pivot on an axis of rotation normal to a primary axis of the holster running from a top opening of the shell for inserting the implement, through a length of the shell, to a bottom of the shell, and parallel to an axis of rotation of the hood.

10. The holster of claim 7, wherein the protruding portion includes a ramp section at a leading edge of the protruding portion and a blocking edge at a trailing edge of the protruding portion.

11. The holster of claim 7, wherein the latch release lever is comprised of at least two rigid sections coupled together with one or more fasteners, with a thumb ledge integral to one of the rigid sections, and wherein the latch release lever is adjustable in length by adjusting a relative position of the at least two rigid sections.

12. The holster of claim 7, wherein the latch release lever is comprised of at least two rigid sections coupled together with one or more fasteners, with a thumb ledge integral to one rigid section, and wherein the latch release lever is adjustable in length by replacing the one rigid section having the thumb ledge with a longer or a shorter rigid section having a thumb ledge.

13. The holster of claim 7, wherein an operating surface of the latch release lever is disposed on a same side of the shell and proximate to an operating surface of the hood release device, such that the latch release lever and the hood release device are capable of being operated by a same finger or thumb in a single fluid motion.

14. The holster of claim 1, further comprising a passive retention system, including:

a retention member comprising a rigid component having an elongated opening through a part of the length of the component, above a contact portion of the component, and a pivot portion at an opposite end of the component, the retention member disposed within the shell and configured to pivot at the pivot portion to increase a retention of the shell by applying pressure to an implement within the shell with the contact portion;

a rigid pusher disposed within the shell and against the retention member, a ramped surface of the pusher configured to apply a pressure to an opposite ramped surface of the retention member to force the retention member to pivot at the pivot portion; and an adjustment screw threaded into the pusher, passed through the elongated opening and trapped at the pivot portion of the retention member, the adjustment screw configured to adjust the pressure applied to the retention member by the pusher, and consequently the amount that the retention member pivots at the pivot portion.

15. The holster of claim 14, wherein the contact portion includes a friction surface on a portion of the contact portion intended to contact the implement.

16. The holster of claim 14, wherein the retention member and the pusher include one or more locating fins on a surface of the retention member and the pusher, the locating fins configured to fit into slots in the shell to locate and to retain the retention member and the pusher at a desired position within the shell.

17. The holster of claim 1, further comprising a sight cover mechanism, including a sight cover enclosure hinged to the shell to cover at least a portion of the opening of the shell when the hood is in a locked configuration; and one or more linkage members pivotally coupled to the sight cover enclosure at one end of the one or more linkage members and pivotally coupled to the hood at another end of the one or more linkage members, such that the sight cover enclosure is pivoted into an open configuration when the hood is rotated into the unlocked configuration and is pivoted into a closed configuration when the hood is rotated into the locked configuration.

18. The holster of claim 17, wherein, the sight cover enclosure includes a flexible cover flap coupled by one or more edges of the flap to the sight cover enclosure.

19. The holster of claim 1, wherein the implement comprises a handgun.

20. A holster for an implement, comprising:

a shell configured to enclose at least part of an implement, the shell having a primary axis running from a top opening of the shell for inserting the implement, through a length of the shell, to a bottom of the shell; and a hood lock mechanism, including:

a hood pivotally coupled to the shell at the top opening of the shell, the hood configured to pivot on an axis normal to the primary axis such that the hood obstructs the top opening of the shell while the hood is in a locked configuration and the hood is rotated to a front of the shell and is clear of the top opening of the shell while the hood is in an unlocked configuration;

a hood release device slideably coupled to the shell and arranged to move in a first direction parallel to the primary axis a first extent to unlock the hood and to move the hood into the unlocked configuration when moved in the first direction a second extent, the hood release device including a post protruding from a surface of the hood release device, configured to engage a slot in the hood while the hood is in the locked configuration, the hood release device arranged to move the post out of the slot when actuated; and an actuation mechanism mechanically coupled to the hood and to the hood release device, the actuation mechanism configured to rotate the hood into the unlocked configuration when the hood release device is moved; and an ejection port lock system, including:

a latch member pivotally coupled to the shell at a first end of the latch member on an axis normal to the primary axis and parallel to an axis of rotation of the hood, and having a protruding portion on an underside of the latch member configured to engage an opening or a recess of an implement while the latch member is in a locked configuration;

a rigid connecting arm pivotally coupled to the latch member at a second end of the latch member; and a latch release lever pivotally coupled to the connecting arm at a first end of the latch release lever and having an operating surface at a second end of the latch release lever, the latch release lever pivotally coupled to the shell at a pivot point between the first end and the second end of the latch release lever, the connecting arm is arranged to move in a first direction when the latch release lever is pivoted at the pivot point by moving the operating surface in a second opposite direction, causing the connecting arm to pivot the latch member into an unlocked configuration.

21. The holster of claim 20, wherein the hood release device is comprised of at least two rigid sections coupled together with one or more fasteners, with a thumb button integral to one of the rigid sections, and wherein the hood release device is adjustable in length by adjusting a relative position of the at least two rigid sections and/or replacing the one rigid section having the thumb button with a longer or a shorter rigid section having a thumb button.

22. The holster of claim 20, wherein the latch release lever is comprised of at least two rigid sections coupled together with one or more fasteners, with a thumb ledge integral to one of the rigid sections, and wherein the latch release lever is adjustable in length by adjusting a relative position of the at least two rigid sections and/or replacing the one rigid section having the thumb ledge with a longer or a shorter rigid section having a thumb ledge.

23. The holster of claim 20, further comprising a passive retention system, including:

a retention member comprising a rigid component having an elongated opening through a part of the length of the component, above a contact portion of the component, and a pivot portion at an opposite end of the component, the retention member disposed within the shell and configured to pivot at the pivot portion to increase a retention of the shell by applying pressure to an implement within the shell with the contact portion;

a rigid pusher disposed within the shell and against the retention member, a ramped surface of the pusher configured to apply a pressure to an opposite ramped surface of the retention member to force the retention member to pivot at the pivot portion; and an adjustment screw threaded into the pusher, passed through the elongated opening and trapped at the pivot portion of the retention member, the adjustment screw configured to adjust the pressure applied to the retention member by the pusher, and consequently the amount that the retention member pivots at the pivot portion.

24. The holster of claim 20, further comprising a sight cover mechanism, including a sight cover enclosure hinged to the shell to cover at least a portion of the opening of the shell when the hood is in a locked configuration, the sight cover enclosure including a flexible cover flap coupled by one or more edges of the flap to the sight cover enclosure; and one or more linkage members pivotally coupled to the sight cover enclosure at one end of the one or more linkage members and pivotally coupled to the hood at another end of the one or more linkage members, such that the sight cover enclosure is pivoted into an open configuration when the hood is rotated into the unlocked configuration and is pivoted into a closed configuration when the hood is rotated into the locked configuration.

* * * * *